United States Patent [19]

Caron et al.

[11] Patent Number: 4,919,566

[45] Date of Patent: Apr. 24, 1990

[54] FILL AND COMPACTION ROLLER USING READILY REPLACEABLE CLEAT ASSEMBLIES

[75] Inventors: James O. Caron; Kenneth H. Pratt, both of Modesto; Richard D. Genger, Alameda, all of Calif.

[73] Assignee: Caron Compactor Co., Modesto, Calif.

[21] Appl. No.: 403,904

[22] Filed: Sep. 1, 1989

Related U.S. Application Data

[63] Continuation of Ser. No. 215,758, Sep. 19, 1988, abandoned, which is a continuation-in-part of Ser. No. 19,791, Feb. 27, 1987, abandoned, which is a continuation-in-part of Ser. No. 798,464, Nov. 15, 1985, abandoned, which is a continuation-in-part of Ser. No. 639,848, Aug. 13, 1984, abandoned.

[51] Int. Cl.[5] ..... E01C 19/26

[52] U.S. Cl. ..... 404/121; 404/124; 301/44 R; 172/122; 172/554

[58] Field of Search ..... 404/121, 122, 123, 124, 404/128; 301/44 R, 44 T; 37/142 R, 142 A, 142 T; 172/540, 554, 556; 403/153, 154, 155, 162, 372; 299/91, 92, 93; 180/20

[56] References Cited

U.S. PATENT DOCUMENTS

| | | | |
|---|---|---|---|
| 1,727,108 | 9/1929 | Julius | 37/142 |
| 2,893,298 | 7/1959 | Averette . | |
| 3,196,956 | 7/1965 | Ratkowski | 37/142 A X |
| 3,252,391 | 5/1966 | Dils | 404/121 |
| 3,274,908 | 9/1966 | Grant | 404/121 |
| 3,340,783 | 9/1967 | Edminster | 301/44 R |
| 3,358,569 | 12/1967 | Averette | 301/44 R |
| 3,598,028 | 8/1971 | Grant | 301/44 R |
| 3,675,350 | 7/1972 | Mulcahy et al. | 37/142 A |
| 3,724,342 | 4/1973 | Caron et al. | 404/121 |
| 3,822,957 | 7/1974 | Caron | 301/44 T |
| 3,891,341 | 6/1975 | Trainor | 404/121 |
| 3,897,642 | 8/1975 | Helton et al. | 37/142 R |
| 3,922,106 | 11/1975 | Caron | 404/121 |
| 4,066,375 | 1/1978 | Caron | 404/121 |
| 4,074,942 | 2/1978 | Cochran | 404/121 |
| 4,165,194 | 8/1979 | Flower | 403/372 X |
| 4,530,620 | 7/1985 | McCartney | 404/121 |
| 4,668,122 | 5/1987 | Riddle | 404/121 |

FOREIGN PATENT DOCUMENTS

| | | | |
|---|---|---|---|
| 1034166 | 4/1978 | Canada | 37/142 A |
| 2015662 | 11/1970 | Fed. Rep. of Germany | 37/142 A |

*Primary Examiner*—Jerome W. Massie, IV
*Assistant Examiner*—Gary Ann Spahn
*Attorney, Agent, or Firm*—Flehr, Hohbach, Test, Albritton & Herbert

[57] ABSTRACT

A compaction roller includes improved cleat assemblies which employ readily removable wear caps. One style of cleat assembly employs means inhibiting twisting of the cap unit about vertical and horizontal axes relative to a support base.

23 Claims, 22 Drawing Sheets

FILL AND COMPACTION ROLLER USING READILY REPLACEABLE CLEAT ASSEMBLIES

This application is a continuation of application Ser. No. 215,758 filed September 19, 1988 now abandoned, which is a Continuation-In-Part of application Ser. No. 19,791 filed February 27, 1987, abandoned, entitled FILL AND COMPACTION ROLLER USING READILY REPLACEABLE CLEAT ASSEMBLIES, which is a Continuation-In-Part of application Ser. No. 798,464, filed November 15, 1985, abandoned, entitled as above, which is a Continuation-In-Part of application Ser. No. 639,848, filed August 13, 1984, abandoned and entitled as above. Each of the above applications has been assigned to Caron Compactor Company.

BACKGROUND OF THE INVENTION

This invention generally concerns compaction machinery such as a roller for mounting upon a driven compaction vehicle, the roller having both destructive and tractive characteristics adapted to break up, crush, grind and compact materials of the size of home appliances as encountered in sanitary land fill operations. More particularly this invention is characterized by readily removable cleats carried by the roller.

Compaction rollers and wheels used on land fill operations and particularly sanitary land fill operations are equipped generally with cleats or feet of a type for grinding and crushing materials to reduce the size and bulk of the material. As shown in U.S. Pat. No. 3,922,106, an earth and sanitary fill compaction roller has been shown employing two different types of feet having replaceable wear caps as part of its cleat assemblies. The wear caps are welded to a base portion of the assembly which in turn is welded to the roller.

While the foregoing arrangement operates entirely satisfactorily, users of the equipment have been known to permit the wear caps to become worn well beyond the point of replacement. In such an instance, the base portion becomes partially worn away so that a new wear cap will no longer fit properly onto its base portion and the entire cleat assembly must be replaced on the roller.

It has been determined that the primary reason that the wear caps are not replaced in time to avoid damage to the base is that the operator must employ a cutting torch to cut them from the roller since they are welded on. This extra inconvenience encourages harmful procrastination.

Accordingly, as disclosed herein a compaction roller has been provided wherein the wear cap can be readily removed using common tools available at the job site. In this way replacement of the wear caps before the supporting base becomes worn to a point requiring its removal has been encouraged.

It has been observed that use of removable wear caps coupled to a fixed base exposes the wear caps to twisting forces capable of damaging the cleat assembly. A cleat assembly as disclosed herein includes means for restraining twisting of the wear cap relative to the base.

In addition, it has been further observed that dirt and/or mud can become sufficiently solidly caked or hardened about the coupling pin (which holds the wear cap to the base so as to make it difficult to decouple the cap. A cleat assembly as disclosed herein employs a novel means for retaining the coupling pin whereby striking the pin dislodges any caked material inhibiting removal of the pin.

In a cleat assembly having a base welded to a rim (or tread portion) of a roller, it has been observed that the weldments should be protected to the extent possible. As disclosed herein the wear cap overlays the weldments to protect them.

This invention further pertains to a fill and compaction roller of the kind noted generally above in which cleat assemblies are distributed across and around a rigid rim or wheel. Each assembly carries a readily removable cap unit retained by a removable pin disposed in one or the other of two pairs of aligned openings formed through the side walls of a shoe.

In addition the cleat assemblies noted immediately above are longitudinally offset with respect to those disposed laterally adjacent thereto in a manner permitting a hammer or other tool to have a relatively clear unobstructed path directed toward the retaining pin for permitting easier removal of the cap assemblies from their associated base.

SUMMARY OF THE INVENTION AND OBJECTS

In general an improved compaction roller carries cleat assemblies comprising a rigid mounting pad assembly adapted to be welded to a rigid cylindrical body or roller and characterized by a bracket protruding therefrom. A coupling opening extends transversely of the bracket. A detachable cap unit coupled to the mounting pad assembly includes a generally hollow body including sloping upwardly converging side walls and transverse end walls extending between the end edges of the side walls. A pair of aligned openings respectively extend through the side walls in alignment with the coupling opening so as to receive a coupling pin therethrough. Means for releasably locking the pin in the openings serves to prevent decoupling of the cap unit and pad assembly in operation while at the same time permitting the coupling pin to be readily removed.

In general it is an object of the present invention to provide an improved fill and compaction roller characterized by readily replaceable cleat assemblies.

It is another object of the present invention to provide an improved cleat assembly in which the wear cap can be readily replaced so as to avoid wearing away the mounting base carrying such wear cap.

Another object of the invention is to provide a cleat assembly of a type requiring minimal time and labor to replace while using simple ordinary tools.

It is a further object of the invention to provide an improved cleat assembly for a fill and compaction roller characterized by means restraining twisting between the wear cap and base.

It is yet an additional object of the invention to provide a cleat assembly for a fill and compaction roller employing means for retaining the coupling pin in a manner whereby striking the pin breaks up caked material otherwise tending to hold the pin.

It is another object of the invention to provide a cleat assembly for a fill and compaction roller wherein the wear cap overlays weldments securing the base to a roller in protective relation.

Yet a further object of the invention is the provision of a cleat assembly having a readily releasable cap unit selectively retainable by a pin disposed through a leading portion of the side walls of the shoe or disposed through a trailing portion.

A further object of the invention is to provide a cleat assembly having a readily removable cap unit carrying a cross bar therein for engaging a notch formed in a bracket welded to a wheel rim so as to prevent twisting of the cleat relative to a base supporting the bracket.

Yet another object of the invention is to provide a cleat assembly having a readily removable cap unit or shoe serving to form both a traction and a demolition cleat.

An additional object of the invention is to provide a cleat assembly having a readily removable cap unit or shoe serving to engage a base in a manner inhibiting twisting of said shoe with respect to the base.

The foregoing and other objects of the invention will become more readily evident from the following detailed description of preferred embodiments when considered in conjunction with the drawings.

DESCRIPTION OF PREFERRED EMBODIMENTS

Figure 1:
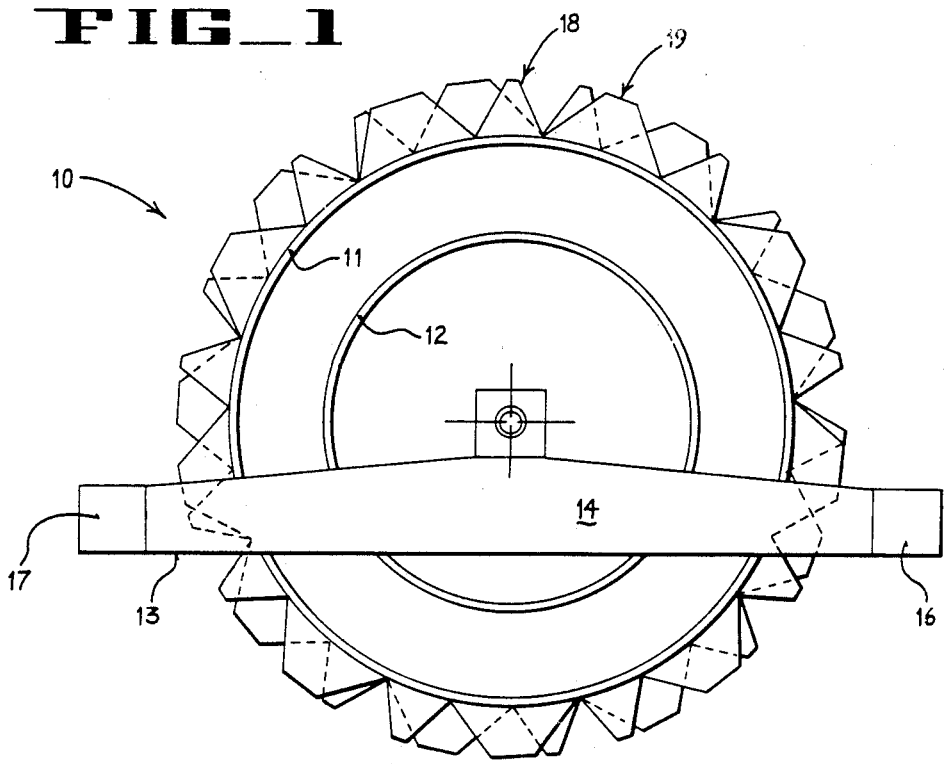
FIG. 1 shows a side elevation diagrammatic view of a fill and compaction roller according to the invention.

A compaction roller 10 constructed according to the present invention and diagrammatically illustrated in FIG. 1 mounted upon a power-driven vehicle 13 (shown only fragmentarily) includes a rigid cylindrical body or rim 11 connected to a centrally disposed drum 12. The roller assembly 10 is represented diagrammatically and can be constructed according to U.S. Pat. No. 3,724,342 assigned to Caron Compactor Company to incorporate cushioning elements, cleaning members, and the like.

Roller 10 has been mounted upon a perimeter frame 14 of vehicle 13. Frame 14 is of a type including cross members 16, 17 extending across the tread of the roller 10.

Cleat assemblies 18, 19 as described more fully below are arranged on the outer surface of the cylindrical rim 11. Cleat assemblies 18 primarily serve to provide traction while the primary function of assemblies 19 is to crush and demolish materials.

Figure 3:
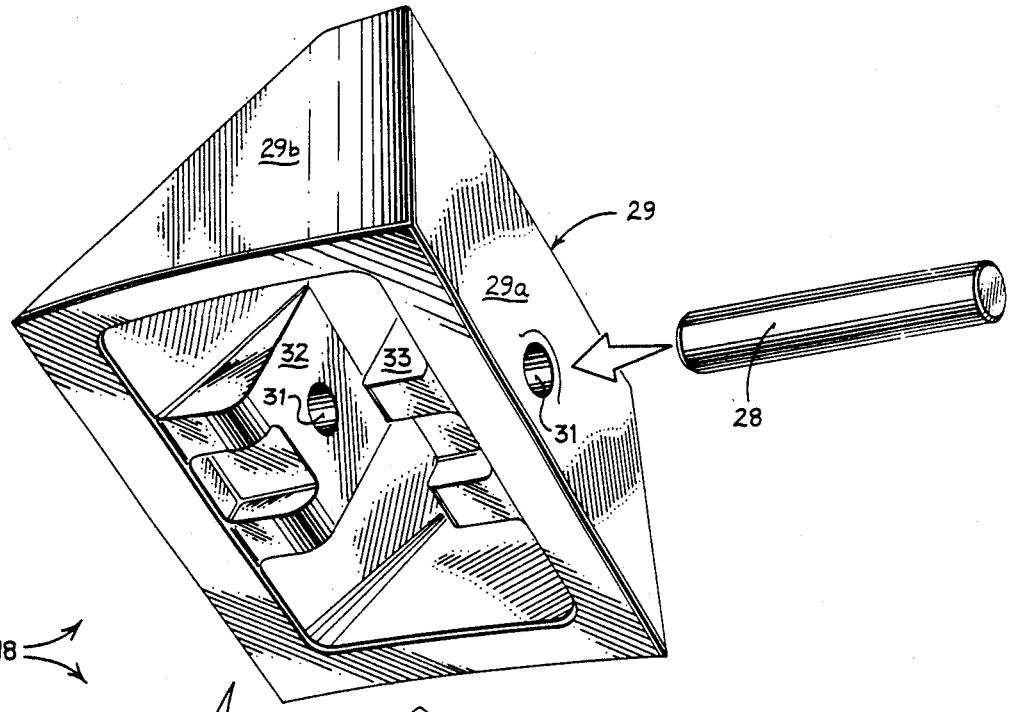
FIG. 3 shows a diagrammatic exploded perspective view of a cleat assembly, the lower portion of the figure being viewed from above and the upper portion being viewed from beneath.

As shown in FIG. 3 cleat assembly 18 includes a rigid mounting pad unit 21 having a base portion 22 curved along edge 21*a* to conform to the curvature of rim 11 so as to be adapted to be welded to the rigid body formed by rim 11. A bracket 23 formed integral with base portion 22 protrudes generally radially outwardly therefrom.

A coupling opening 24 extends transversely of bracket 22 and enlarged annular recesses 26 surround each end of opening 24.

Radially enlargeable split rings 27 when disposed within recesses 26 serve to lock a coupling pin 28 therein as described further below for retaining a wear cap unit 29. Accordingly wear cap unit 29 is adapted to be readily releasable coupled to base portion 22. Wear cap unit 29 has a generally hollow body including sloping upwardly converging outer side walls 29*a* and transverse end walls 29*b* extending between the end edges of side walls 29*a*. A pair of aligned openings 31 extend through side walls 29*a* in position to be aligned with coupling opening 24 of bracket 23. In this way coupling pin 28 can be readily disposed to extend through openings 31 and 24 to couple wear cap unit 29 to its mounting pad unit 21.

Means for readily releasably locking pin 28 in openings 31, 24 serves to prevent decoupling of cap unit 29 from pad assembly 21 as now to be described.

Figure 6:
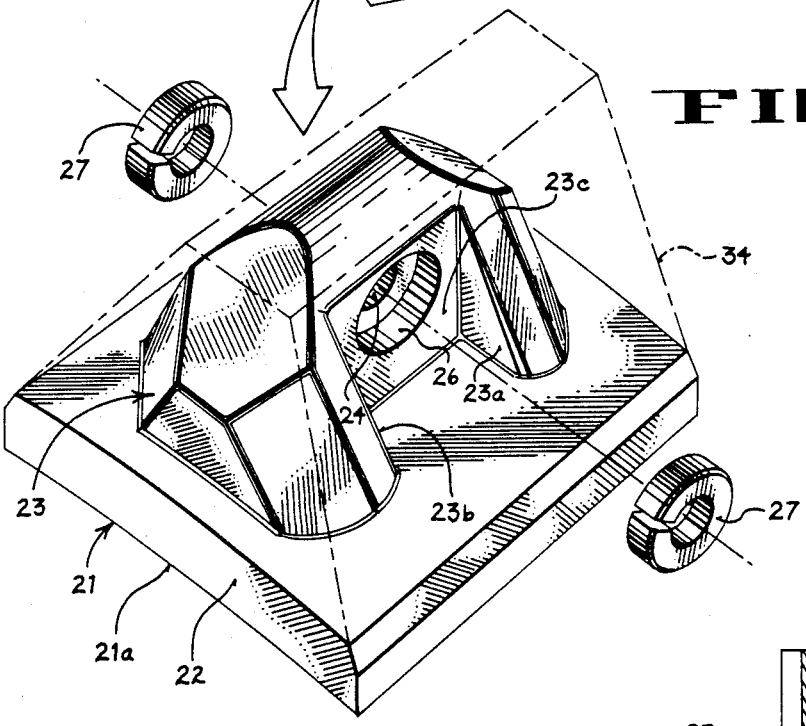
FIG. 6 shows a diagrammatic transverse section view of an assembled cleat assembly of the type shown in FIG. 3 taken along the plane of the horizontal diameter of the coupling pin.
Figure 6:
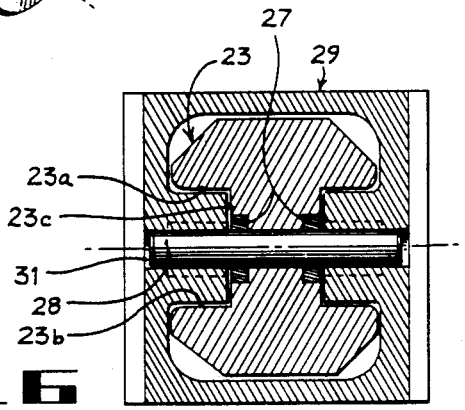
Figure 4:
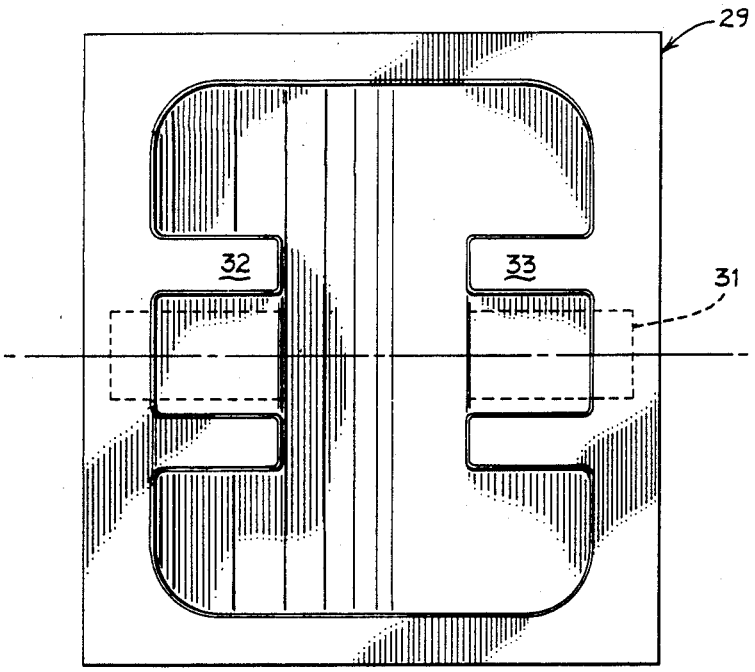
FIG. 4 shows a plan view of the wear cap of the cleat assembly of FIG. 3 viewed from beneath.
Figure 5:
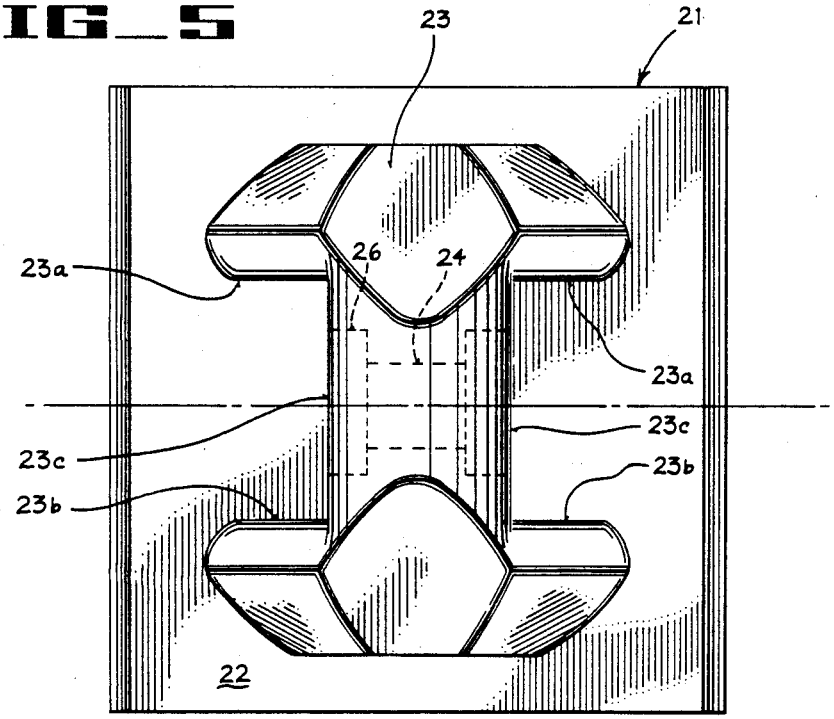
FIG. 5 shows a top plan view of the rigid mounting pad assembly shown in FIG. 3.

While the diameter of openings 31, 24 is sufficient to readily permit the insertion of pin 28 therethrough, the inner diameter of split rings 27 is somewhat less than the diameter of coupling pin 28. Accordingly, in order to dispose coupling pin 28 fully within openings 31 it is necessary for it to be forced through the center of each split ring 27. Thus, as shown in FIG. 6 pin 28 has been disposed within openings 31, 24, and through each of split rings 27 so that pin 28 cannot be inadvertently or accidentally removed.

When it is desired to remove cap unit 29 a hammer can be used to drive a screw driver or similar rigid tool against an end of pin 28 to move it through cap unit 29 until pin 28 is released from split rings 27.

Within cap unit 29 means have been provided serving to closely guide cap unit 29 onto bracket 23. Accordingly, a pair of confronting substantially parallel abutments 32, 33 extend radially outwardly along the inner surface of the confronting sloping walls 29*a* of the hollow body of cap unit 29.

As noted above openings 31 extend through these abutments in alignment with coupling opening 24 of bracket 23. The confronting faces 23*a*, 23*b* of a pair of transverse flanges flank each end of coupling opening 24 to form a guide slot at opposite ends of opening 24 for receiving an associated one of abutments 32, 33.

Bracket 23 includes a registration surface or face 23*c* extending between the confronting faces 23*a*, 23*b*. When cap unit 29 has been disposed onto bracket 23 as represented by the phantom lines 34 in FIG. 3 the opposed faces of abutments 32, 33 will be disposed in closely spaced relation to the registration surfaces 23*c* of bracket 23 so as to fully capture split rings 27 in their respective recesses 26.

Accordingly, after cap unit 29 has been placed over mounting pad unit 21, and with split rings 27 disposed within their respective recesses 26 the faces of abutments 32, 33 will be closely spaced from and capture rings 27 whereby as pin 28 is inserted through the first opening 31 the first ring 27 encountered will be expanded radially as pin 28 is driven into the wear cap unit 29. Pin 28 will enter the second split ring and expand it as well because the confronting face of an associated abutment 32 (as shown) will prevent the ring from being moved out of its recess by pin 28.

Thus, as explained above, bracket 23 includes a pair of "slots" on opposite sides of the bracket for receiving abutments 32, 33. The "slots" are defined by the wall faces 23*a*, 23*b* and 23*c*. Accordingly, these guide "slots" serve to receive an associated one of the abutments closely spaced therein.

From the foregoing it will be readily evident that there has been provided an improved cleat assembly such as cleat assembly 18 wherein the wear cap can be readily removed using ordinary tools of the type found at the job site simply by driving the pin 28 far enough through the cap unit 29 to release both split rings 27 therefrom.

It has been observed that the time and labor involved in replacing a worn-out wear cap according to this invention is sufficiently minimal that the wear caps are more likely to be replaced before damage is incurred by the rigid mounting pad unit 21, causing it to be required to be cut off and replaced.

In this way it is possible to avoid the unnecessary extra time and expense required in cutting off the damaged rigid mounting pad unit 21.

The mounting pad unit 21 and the cap unit 29 are each formed using well known steel casting processes. Accordingly any substantially vertical section, such as end walls 29*b* of cap unit 29 and the end walls 23*d* of bracket 23, will be slightly convergent extending away from base portion 22 by reason of the draft angle typical to the casting process. It should be appreciated that other conventional fabrication techniques such as forging may be used to construct the cleat assemblies as well.

Figure 7:
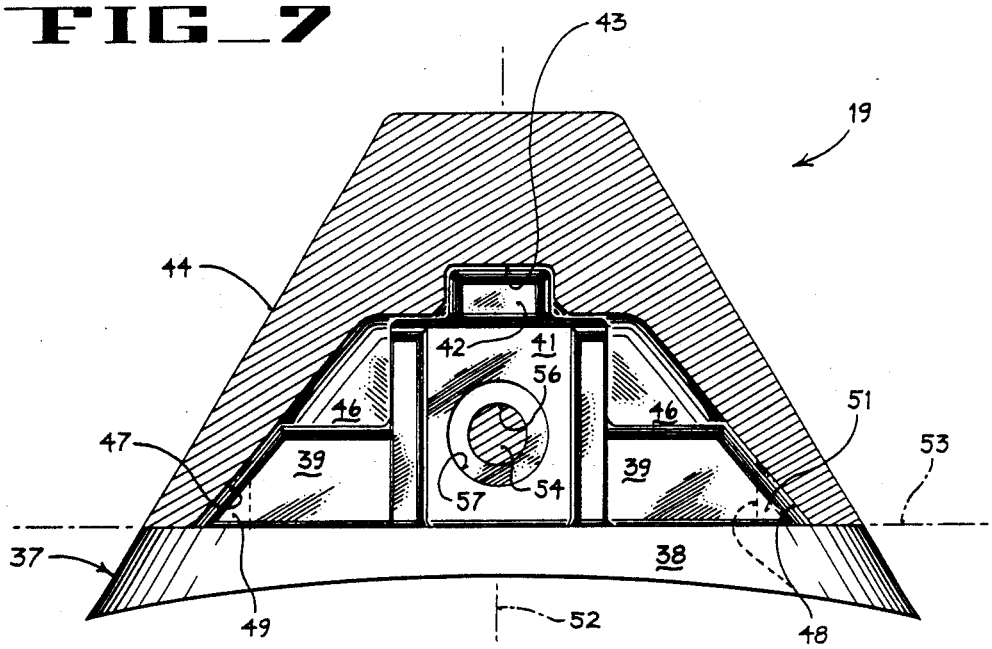
FIG. 7 shows a side elevation section view of a cleat assembly of a type for crushing.

Referring next to FIG. 7, a cleat assembly 19 primarily used for crushing, breaking and grinding of materials of the size of home appliances as encountered in sanitary land fill operations is described. The crushing cleat assembly 19 includes a rigid mounting pad unit 37 including a rigid metallic base portion 38. Base portion 38 supports an elongate relatively thin aligning guide 39 formed integrally with base portion 38.

Aligning guide 39 includes an upwardly extending bracket portion 41 characterized by an upwardly protruding key 42 disposed within a downwardly opening pocket 43 defined within a removable wear cap 44. Like the traction cleat asembly 18, the bracket 41 forms a pair of "slots" on opposite sides of the bracket for receiving abutments (not shown) in the cap 41. The slots are formed by registration surface 44*c* and the interior surfaces of shoulders 41*a* and 41*b*.

The rigid mounting pad assembly 37 and its associated aligning guide 39 support wear cap 44 from within in a manner to minimize twisting and bending of wear cap 44 with respect to base portion 38. Accordingly, aligning guide 39, including key 42, serves to provide three spaced points of support as now to be described.

The hollow interior 46 of cap 44 has a pair of interior seating surfaces 44*a* that slopes downwardly and away from each other to provide a snug fit between the ends of the aligning guide 39 and the interior 46 of cap 44. Notches 47 and 48 are formed at opposite ends of the cap 44 for receiving the tip ends 49, 51 of guide 39. Accordingly, as thus mounted, by lodging the tips 49, 51 in notches 47, 48 wear cap 44 is restrained against being twisted relative to base portion 38 about an axis normal thereto, such as axis 52. The notches 47 and 48 are formed by a pair of spaced apart shoulders formed integrally with the cap 44.

Further, key 42 engaged in pocket 43 serves to restrain wear cap 44 from being twisted laterally with respect to base portion 38, for example, as about the axis 53 parallel to base portion 38.

Finally, a coupling pin 54 extends through an opening disposed transversely of bracket portion 41 as described above with regard to bracket 23. Each end of the coupling opening 56 is similarly surrounded by an annular recess 57, just as the opposite ends of bracket 23 taper mutually away from each other, and engage seating surfaces within cap unit 29.

Coupling pin 54 accordingly retains wear cap 44 to mounting pad assembly 37.

Finally, the underside of base portion 38 is arcuately formed to conform to the peripheral surface of rim 11 and adapted to be welded thereto.

In this way as wear cap 44 becomes worn, it can be readily replaced without undue expenditure of labor and time.

Figure 8:
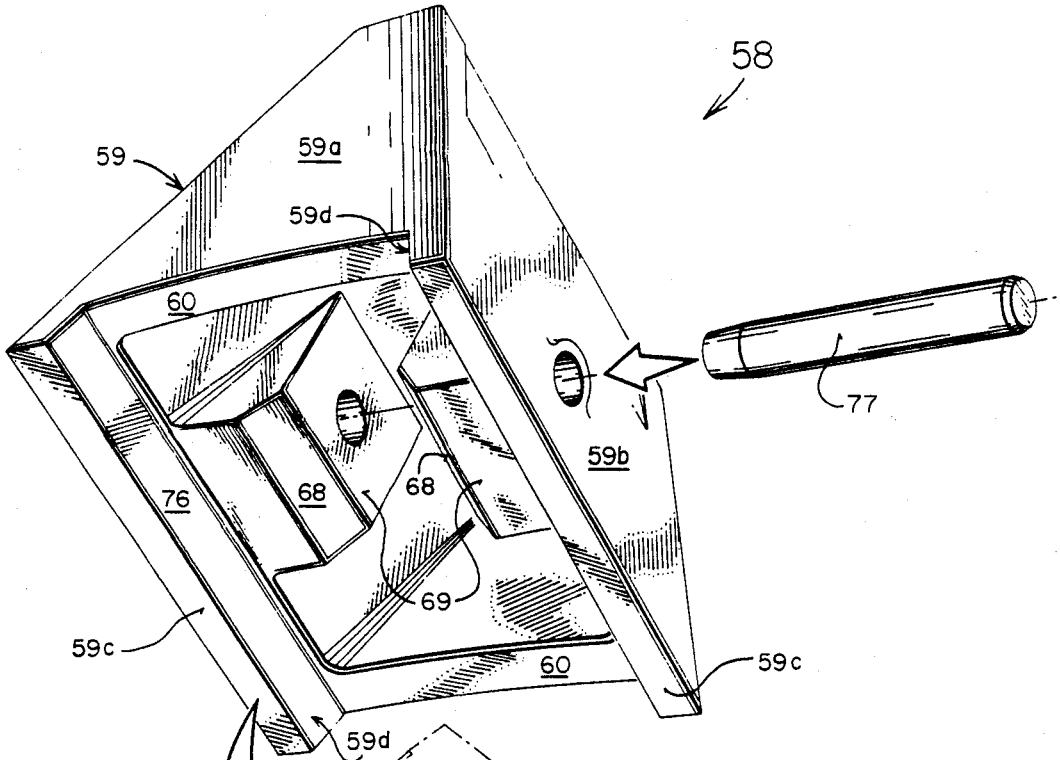
FIG. 8 shows a diagrammatic exploded perspective view of a cleat assembly according to another embodiment of the invention, the lower portion of the figure being viewed from above and the upper portion being viewed from beneath.

According to another embodiment of the invention, as shown in FIG. 8, a cleat assembly 58 along the general lines as previously shown and described with respect to FIG. 3 includes means serving to resist twisting of a cap unit 59 with respect to its rigid mounting pad assembly 61 while improving the seating of cap unit 59 onto pad assembly 61.

Thus, assembly 61 includes a base portion or simply base 62 adapted to be welded onto a rigid annular body or wheel rim. A bracket 63 formed integral with base 62 protrudes generally radially outwardly from base 62 when attached to a wheel or other rigid annular body forming a wheel or roller. Bracket 63 includes a coupling opening 64 extending transversely through bracket 63.

Seating surfaces 67 slant downwardly and away from opposite sides of bracket 63 and are supported by both base 62 and bracket 63. A pair of confronting, substantially parallel abutments 69 protrude from and extend radially outwardly along the inner walls of cap unit 59. The radially inner free edges of abutments 69 have been bevelled to provide the surfaces 68 which cooperate with seating surfaces 67 so as to provide a more integral seating of cap unit 59 when mounted onto pad assembly 61.

Primary resistance to twisting of cap unit 59 with respect to assembly 61 originates from the flanges 71, 72 extending along a pair of parallel side edges of base 62. Tapered side surfaces 73, 74 of base 62 slope upwardly from the top surface of flanges 71, 72 respectively to the level of the top surface 62*a* of base 62.

Cap unit 59 includes transverse end walls 59*a* extending between the end edges of the side walls 59*b*. Walls 59*a* depend sufficiently to engage the top surface 62*a* of base 62. Side walls 59*b* extend downwardly beyond the end edges 60 of end walls 59*a* and the top of base 62. Side walls 59*b* are disposed at an angle corresponding to the angle of the tapered side surfaces 73, 74 so as to snugly fit alongside surfaces 73, 74 while the end surfaces 59*c* of side walls 59*b* engage flanges 71, 72 to provide support therebetween. A pair of aligned openings 31 extend through side walls 59*b* and abutments 69 to receive coupling pin 77.

As thus arranged, with cap unit 59 securely mounted to rigid mounting pad assembly 61, the tapered side surfaces 73, 74 cooperate with the confronting inner surfaces 76 of the downwardly depending flange portions 59*d*.

It has been observed that dirt and other hardenable materials form an extremely compacted cake about retaining rings 27 (FIG. 3) so that the cake must first be broken up before the pin can be dislodged with ordinary tools. Means, as now to be described, have been provided in the embodiment of FIG. 8 for simultaneously breaking up the compacted cake of material while at the same time serving to release a coupling pin 77.

Figure 9:
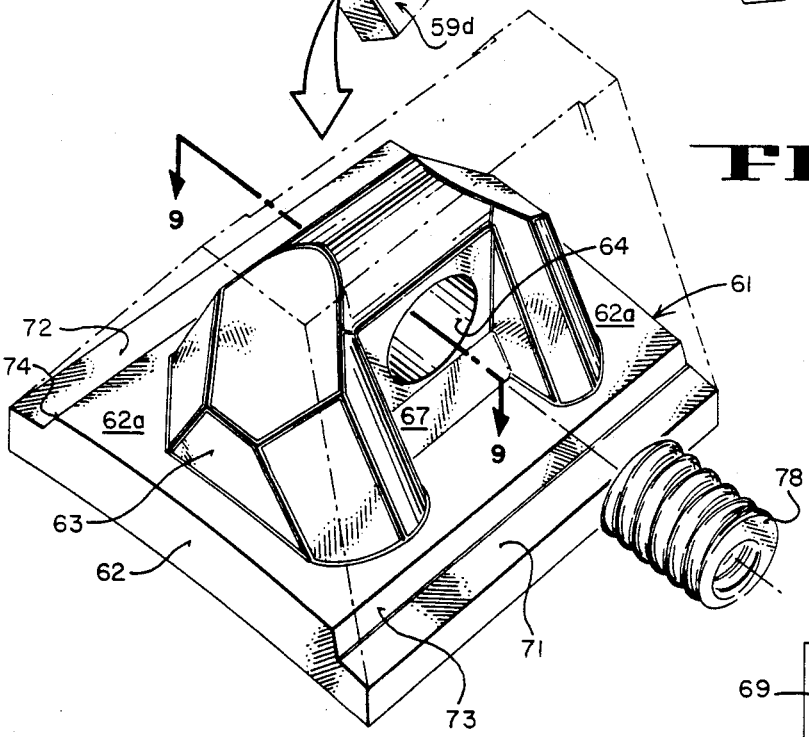
FIG. 9 shows a diagrammatic transverse section view of an assembled cleat assembly of the type shown in FIG. 8 taken along the plane of the horizontal diameter of the coupling pin.
Figure 9:
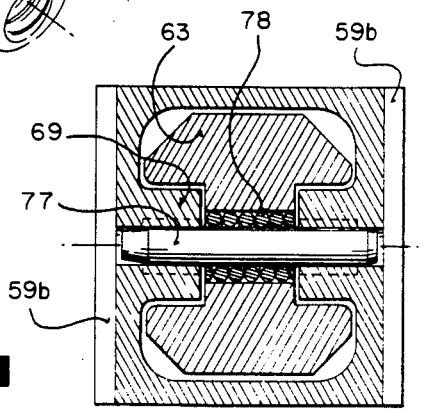

Accordingly, a coupling pin retainer as shown in FIG. 8 includes a length of coiled spring wire 78 disposed within coupling opening 64. The coil 78 of spring wire engages coupling pin 77 for retaining cap unit 59 to mounting pad assembly 61. Preferably, as shown in FIG. 9, the exterior dimensions of the coil 78 corresponds substantially to the diameter and length of coupling opening 64. The outside diameter of coupling pin 77 slightly exceeds the inside diameter of the opening through coil 78 so as to provide a firm engagement therebetween.

When it is desired to remove cap unit 59, pin 77 can be struck by using a rigid elongate tool such as a punch or screw driver in contact therewith and then striking the rigid tool.

Application of this force to pin 77 tends to extend the length of coil 78. In this manner, the convolutions of coil 78 separate slightly for a moment whereby caked material will be readily broken up to more easily permit pin 77 to be driven through spring 78 for decoupling cap unit 59 from rigid mounting pad assembly 61.

Figure 10:
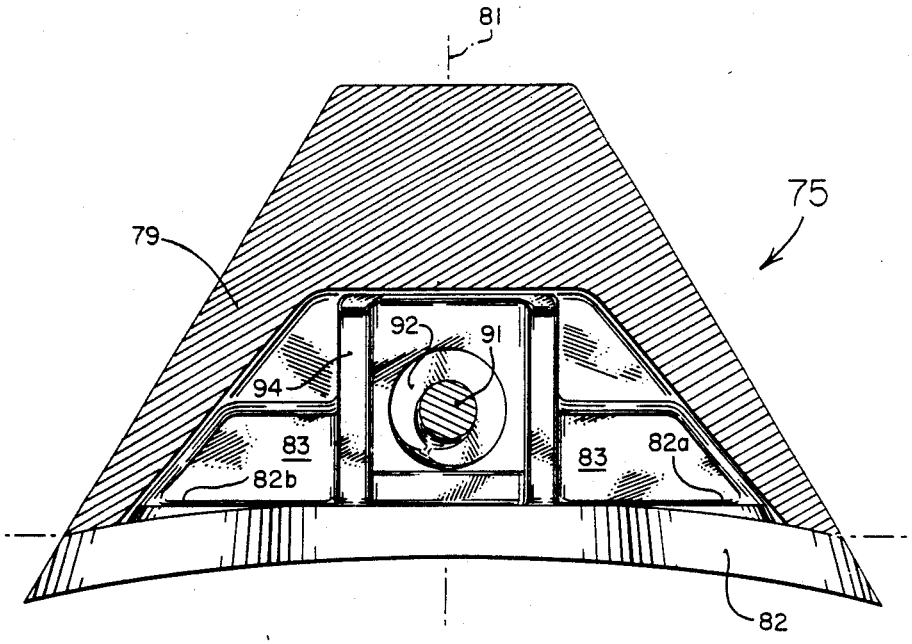
FIG. 10 shows a side elevation section view of a cleat assembly of a type for crushing, according to another embodiment of the invention.
Figure 11:
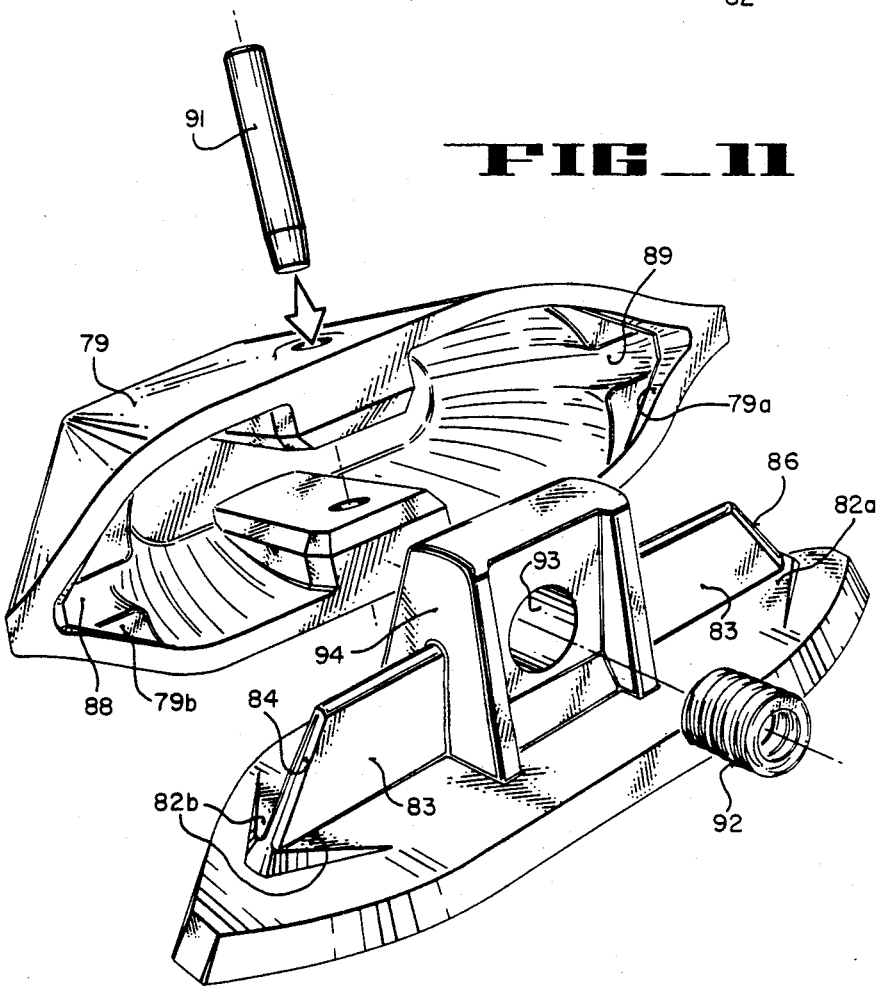
FIG. 11 shows a diagrammatic perspective exploded view of the embodiment shown in FIG. 10, the upper left hand portion showing a wear cap lying on its side.
Figure 12:
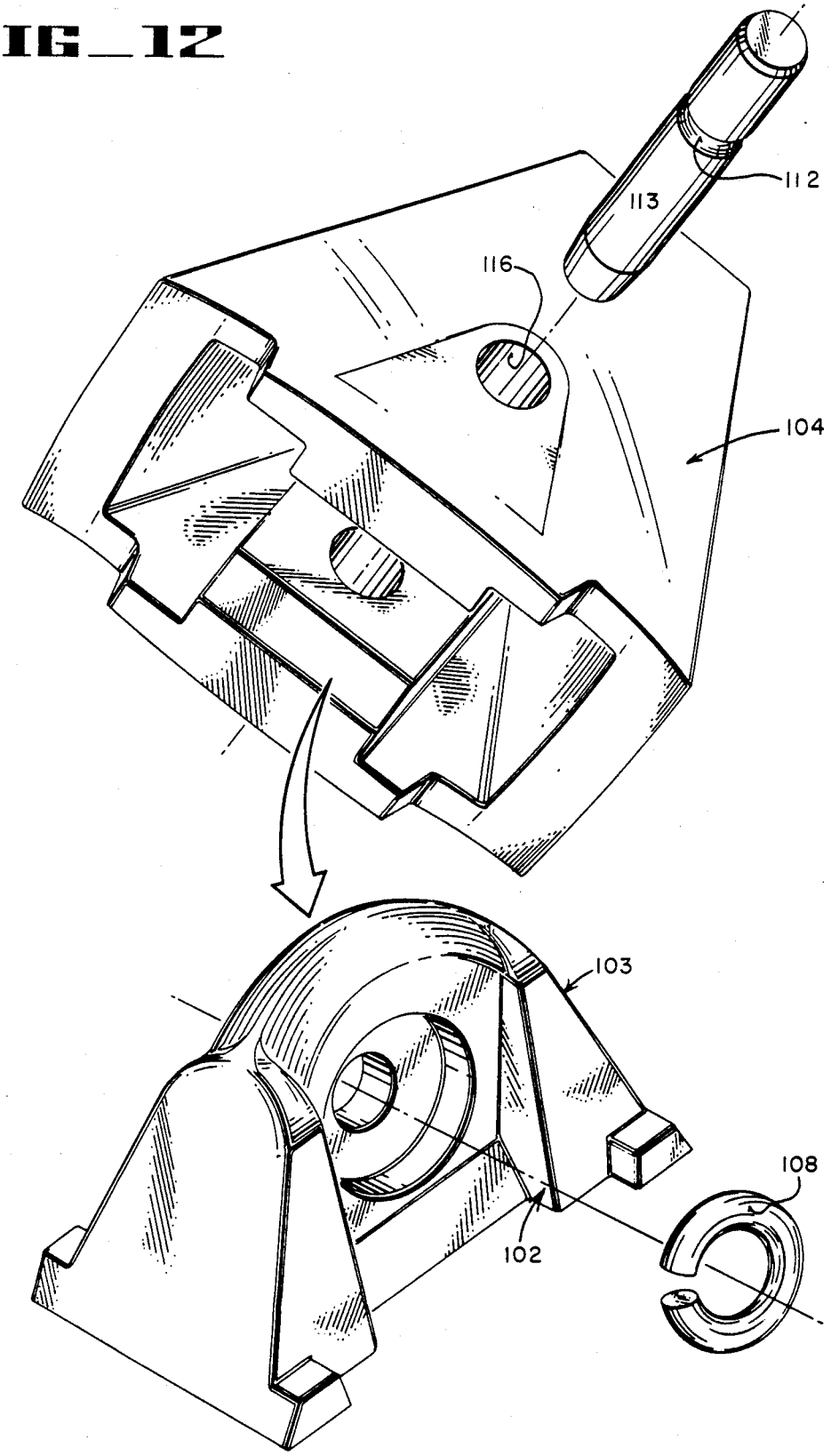
FIG. 12 shows a diagrammatic exploded perspective view of a cleat assembly, according to another embodiment, the lower portion of the figure being viewed from above and the upper portion being viewed from beneath.
Figure 13:
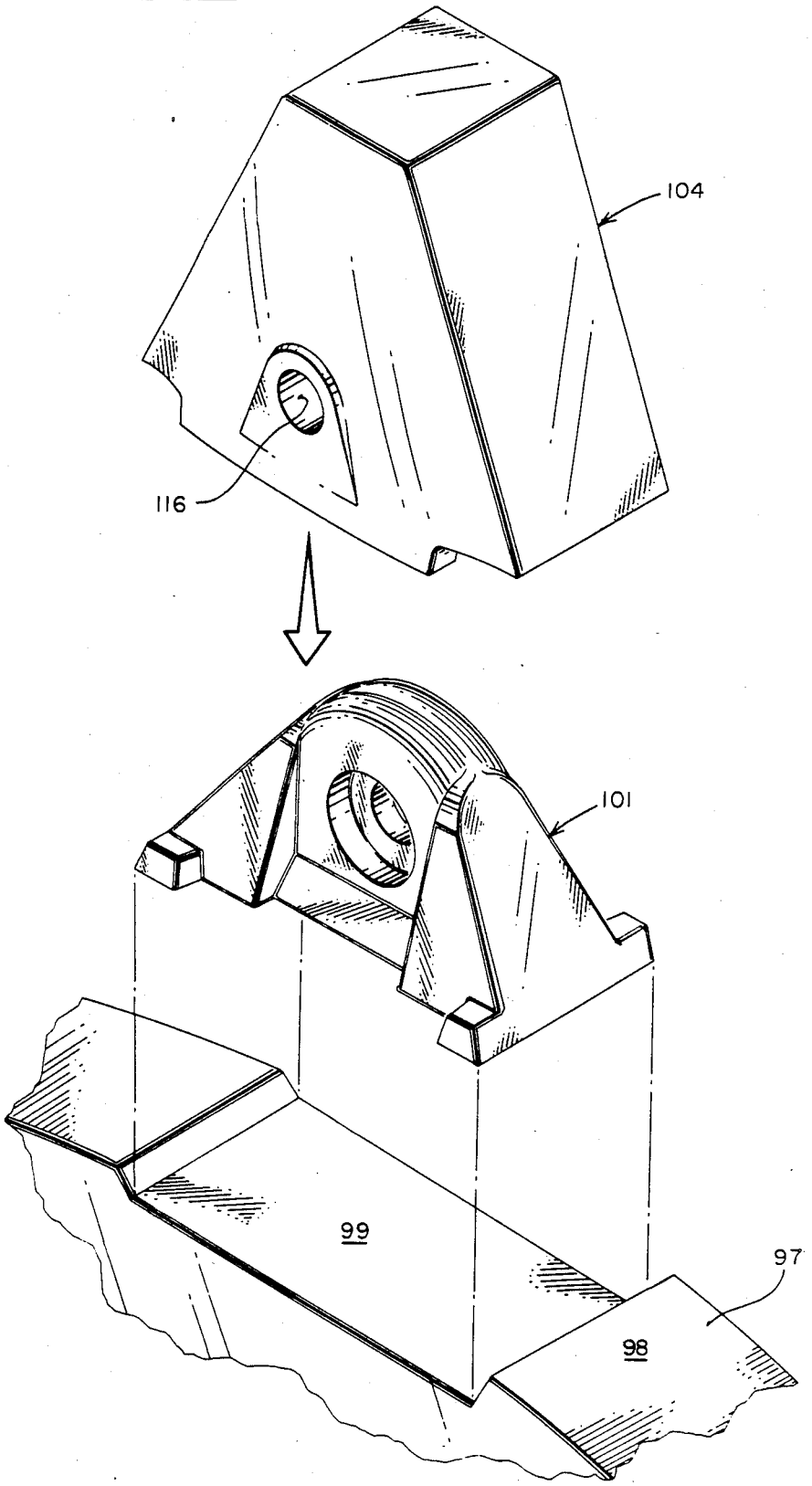
FIG. 13 shows a diagrammatic exploded perspective view of the embodiment shown in FIG. 12 as applied to a mounting shoe.

According to another embodiment of the invention, as shown in FIGS. 10 and 11, a cleat assembly 75 along the general lines of the cleat assembly shown in FIG. 7 includes means for resisting twisting of the removable wear cap 79 about an axis 81 normal to the mounting base 82. Mounting base 82 is adapted to be welded to a rigid annular body such as the wheel of a compacting vehicle as described above, or roller. Base 82 includes an elongate relatively thin aligning guide 83.

Aligning guide 83 preferably is formed integrally with base 82. The ends 84, 86 of guide 83 slope downwardly toward base 82 and away from each other to define detent portions described below.

As arranged, aligning guide 83 extends lengthwise of base 82 substantially along a mid-plane thereof protruding generally radially outwardly from base 82 in a plane including the ends of the guide.

An elongate removable wear cap unit 79 having a hollow interior has been formed to include notches 88, 89 at each end for receiving the ends 84, 86 respectively of aligning guide 83 therein. With wear cap 79 disposed onto base 82 with the ends 84, 86 of aligning guide 83 engaging notches 88, 89, the interengagement therebetween serves to restrain twisting of wear cap 79 relative to base 82 about an axis 81 normal thereto.

Means for readily releasably coupling wear cap 79 to base 82 includes a coupling pin 91 for engaging a length of coiled spring wire 92 disposed in a coupling opening 93 extending through a central bracket portion 94 for retaining pin 91 as described above.

In addition to employing ends 84, 86 of aligning guide 83 to engage pockets or notches 88, 89 to resist twisting forces acting upon wear cap 79 about axis 81, base 82 further includes sculptured or raised registration surface portions **82*a*, 82*b* at each end and protruding radially outwardly from base 82. Corresponding relieved surface portions 79*a*, 79*b* defined within the inner edge margin of cap unit 79, serve to nest with and to register with the surface portions 82*a*, 82*b* to further restrain twisting of wear cap 79**:

A further embodiment of the invention, as shown in FIGS. 12 through 16, provides a fill and compaction roller of a type having a rigid annular rim or body. A number of rigid arcuate shoes such as the shoe 97 are adapted to be welded to the tread surface of the rim to fully encircle the rim with shoes 97. Shoe 97 has a broadened radially outer surface 98 formed to include a shallow pocket 99 extending across and along outer surface 98 for receiving a rigid mounting pad or base 101. Mounting pad 101 includes a base portion 102 and a bracket 103 integral to base portion 102. Bracket 103 protrudes radially away from outer surface 98, and pocket 99 receives base portion 102 disposed therein.

Weldments 106, 107 join the ends of base portion 102 to shoe 97. A readily removable cap unit 104 covers both the bracket 103 and weldments 106, 107 in protective relation.

Means coupling cap unit 104 to bracket 103 for readily releasably retaining cap unit 104 thereto includes a single retaining ring 108 disposed in one of the two enlarged recesses 109, 111 surrounding the outer ends of coupling opening 118 and engaging an annular groove 112 formed around coupling pin 113.

Figure 14:
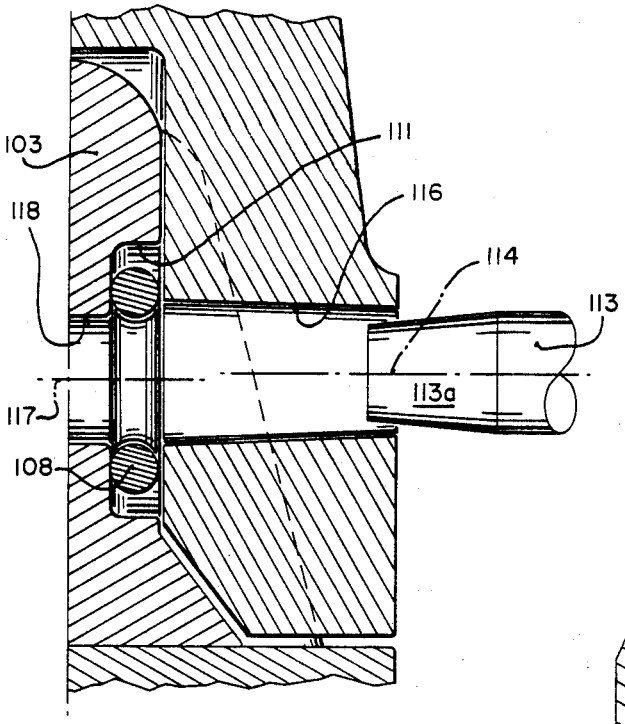
FIG. 14 shows a diagrammatic enlarged detail view in section taken in a vertical plane including the locking pin.
Figure 15:
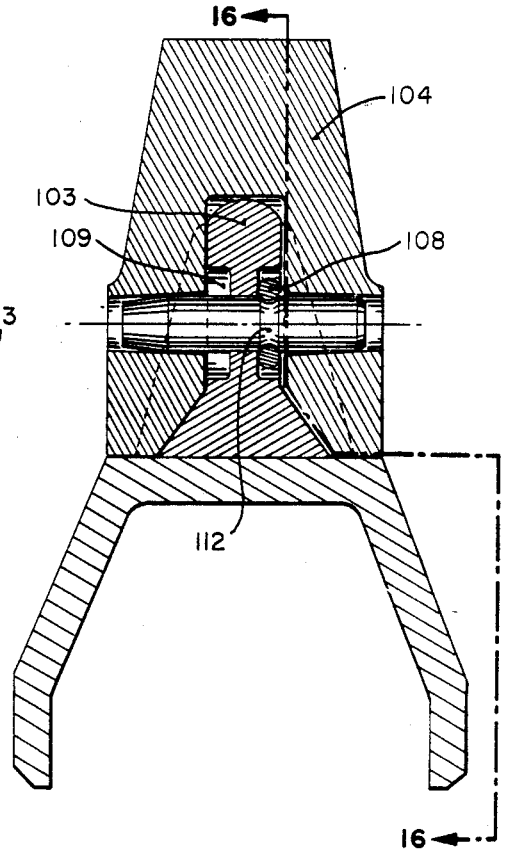
FIG. 15 shows an elevation section view taken along the line 15—15 of FIG. 16.
Figure 16:
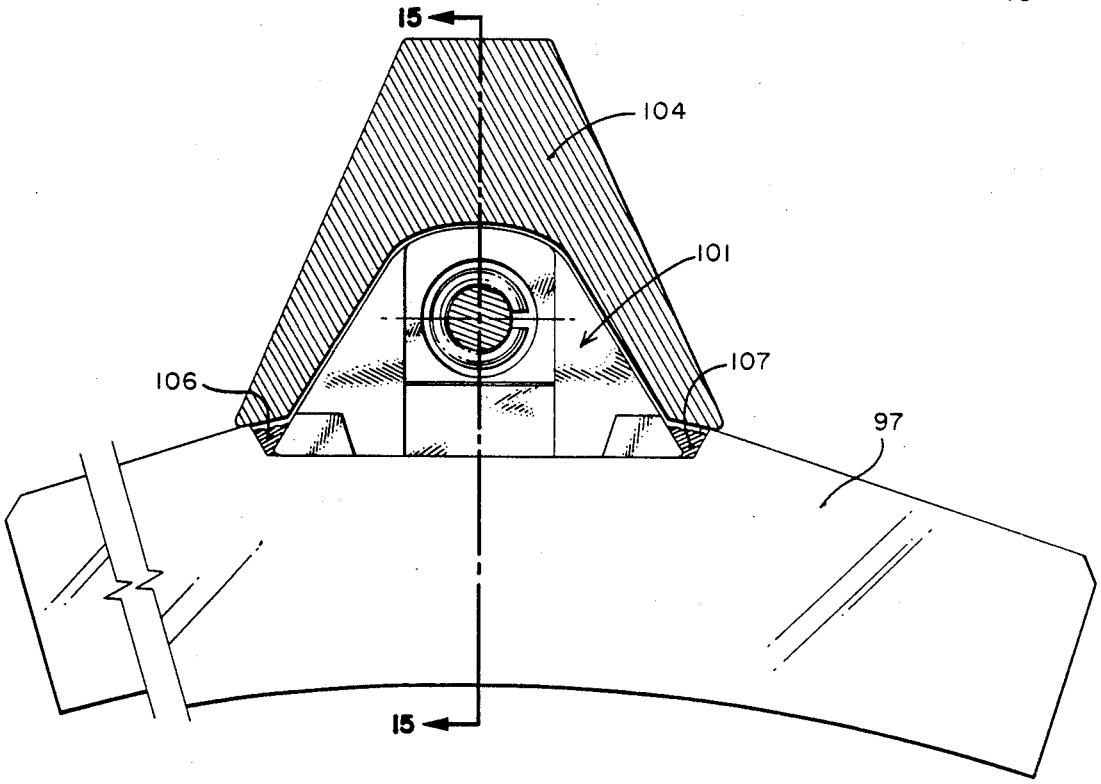
FIG. 16 shows a side elevation view taken along the line 16—16 of FIG. 15.

In attaching cap unit 104 to bracket 103, as shown best in FIG. 14, the axis 114 of coupling pin 113, when entering an alignment opening 116 will lie slightly above the axis 117 defined through coupling opening 118 of bracket 103.

In this way as coupling pin 113 is driven inwardly, the tapered end **113*a* will enter and serve to draw cap unit 104 downwardly to align axis 114 with axis 117. Retaining ring 108 expands with the inward movement of pin 113 and passes along the body of pin 113 until ring 108 engages the annular groove 112 extending around pin 113**.

Apparatus of the kind described, when employed in land fill operations, can encounter a wide variety of refuse and trash which, in some instances, can be harmful. For example, it has been observed that wire, for example, when encountered by cleats having removable cap units, can enter beneath the cap unit and above the base and cause additional damage. Accordingly, as shown best in FIG. 16, weldments 106, 107 are fully protected by the overlapping lip of cap unit 104 while the slope of cap unit 104 tends to deflect materials such as wire away from weldments 106, 107.

Figure 2:
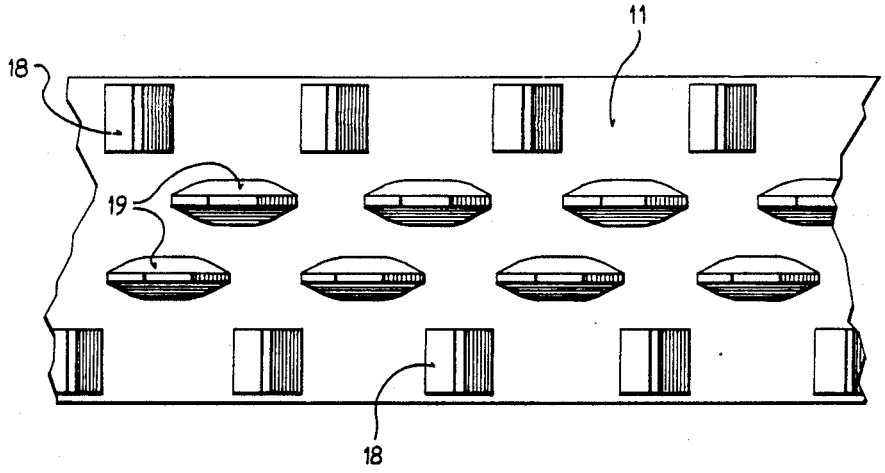
FIG. 2 shows an enlarged detailed view of the "tread" portion of the roller in FIG. 1 and disclosing both tractive and crushing cleats.

According to yet a further embodiment of the invention as shown and described with respect to FIGS. 17 through 24, a fill and compaction roller 120 having an annular rigid rim or wheel 121 includes a number of cleat assemblies 122 distributed across and around rim 121 as shown best in FIG. 2 and as described further below.

Each cleat assembly 122 carries a readily removable cap unit 123 retained by a removable coupling pin 124 disposed in one or the other of two pairs of aligned openings 126, 127 formed to extend through the side walls 128, 129 of a shoe 130 welded to rim 121.

Figure 18:
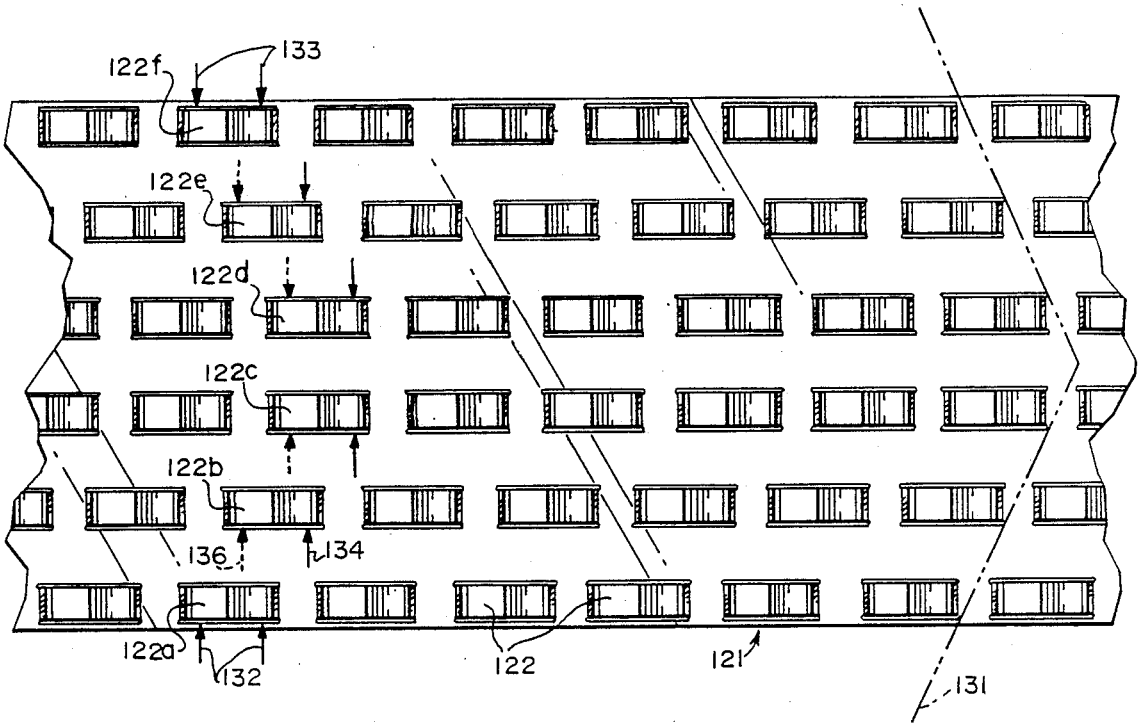
FIG. 18 shows an explanatory plan view of a portion of FIG. 17 with the portion having been "unrolled"

The arrangement of cleat assemblies 122 as viewed in plan and shown diagrammatically in FIG. 18 are offset with respect to each other in a manner permitting a hammer or other tool to have a relatively clear path directed toward the retaining pin so as to permit easier removal of the cap assemblies 123 from their associated shoes. Accordingly as shown in FIG. 18 six laterally spaced rows of cleat assemblies 122 are offset longitudinally with respect to each other in a manner permitting a hammer or other tool to have a relatively clear path directed toward the retaining pin 124 so as to permit easier removal of the cap assembly from its associated shoe. The arrangement of the cleat assemblies defines a chevron configuration as represented by the phantom line 131.

Thus, as shown in FIG. 18, arrows in solid lines and in phantom lines are directed against the side of a number of cleat assemblies **122*a* through 122*f* for purposes of indicating the accessibility of coupling pins 124 when located in a forward or trailing location in the cleat assembly. Solid line arrows indicate an unobstructed direct access for striking the end of a coupling pin while arrows in dashed lines are intended to suggest an obstructed path for striking the pin 124**.

Accordingly, with respect to cleats **122*a* and 122*f* the arrows 132, 133 indicate a clear access to striking either of two coupling pins 124 extending through shoe 130** whereby they can easily be dislodged.

In the case of cleat assemblies **122*b* and 122*e*, the fact that they have been advanced forwardly with respect to cleat assemblies 122*a*, 122*f*, respectively, serves to locate the leading coupling pin of cleat assembly 122*b*, for example, in a position whereby a technician has a substantially unobstructed path to striking the leading coupling pin, such path being represented by the arrow 134. By comparison, when necessary to remove the trailing coupling pin in cleat assembly 122*b*, a striking path which must be followed is indicated by arrow 136 in dashed lines thereby indicating the presence of the obstructing cleat 122*a*** forming an obstruction to a free striking path toward the left hand coupling pin.

From inspection of FIG. 18, it is clear that by disposing coupling pin 124 through openings 127 (FIG. 19), each of the six cleats extending across roller 120 can be easily removed by virtue of the presence of a clear path along which a striking tool can be moved to remove the coupling pins. In this way, the cap assembly associated with each cleat assembly can be more easily removed from its associated shoe.

Side walls 128, 129 lie disposed in spaced confronting relation to each other while a pair of end walls 137, 138 and a rigid partition 139 intermediate the end walls all extend between the side walls 128, 129 to define a pair of adjacent pockets 141, 142. Partition 139 serves to strengthen the spacing between side walls 128, 129 as well as to provide support to cap unit 123 as described further below.

Side walls 128, 129 as viewed in side elevation have the general shape of a trapezoid including top, bottom and end edges 143, 144, 145, 146, respectively. The bottom edges of shoe 130 are arcuately formed to conform to the arc of rim 121 to permit shoe 130 to be readily welded snugly thereto.

The upper edge of each side wall 128, 129 includes first and second portions 143*a*, 143*b* inclined upwardly from its associated end wall. The upper edge 143 includes a notch 143*c* forming an opening leading into the interior of shoe 130. The upper edges of shoe 130 serve to form a seat for supporting a wear cap unit 123 disposed thereon.

Accordingly, means forming a readily replaceable wear cap unit 123 carried by shoe 130 includes an integral unit having a cap portion 123*a* adapted to engage the ground or other surface supporting the fill and compaction roller 120. The underside 123*b* of cap portion 123*a* includes a surface formed and disposed to mate with and be seated upon the inclined portions 143*a*, 143*b* of the upper edges of shoe 130.

Means for readily releasably coupling wear cap unit 123 to shoe 130 includes a pair of elongate rigid tongues, 147, 148. Tongues 147, 148 have been formed integral with cap unit 123 and lie substantially in a mid-plane of cap portion 123 and spaced longitudinally apart to form an elongate mounting slot 149 therebetween. Slot 149 includes a pair of converging side walls 149*a*, 149*b* therein for receiving partition 139 in supporting relation therebetween. Thus, when tongues 147, 148 are disposed into pockets 141, 142 of shoe 130 the divergent sides of partition 139 firmly engage the convergent sides 149*a*, 149*b* of slot 149 and provide substantial support to cap unit 123*a*.

Figure 19:
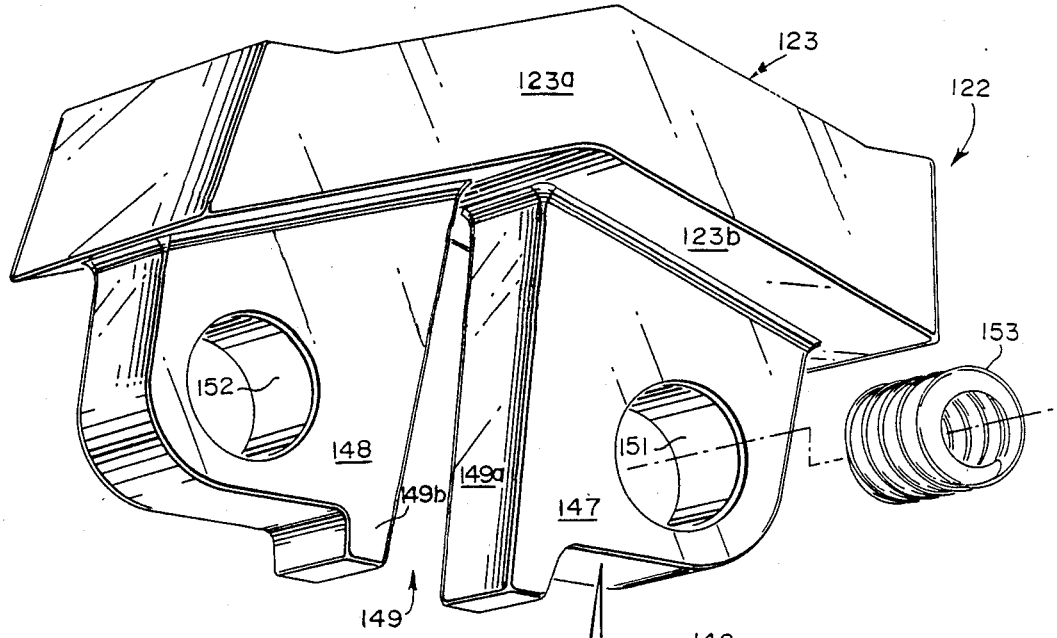
FIG. 19 shows a diagrammatic exploded perspective view of a cleat assembly employed in the embodiment of FIG. 17, the lower portion of the figure being viewed from above and the upper portion being viewed from beneath.
Figure 20:
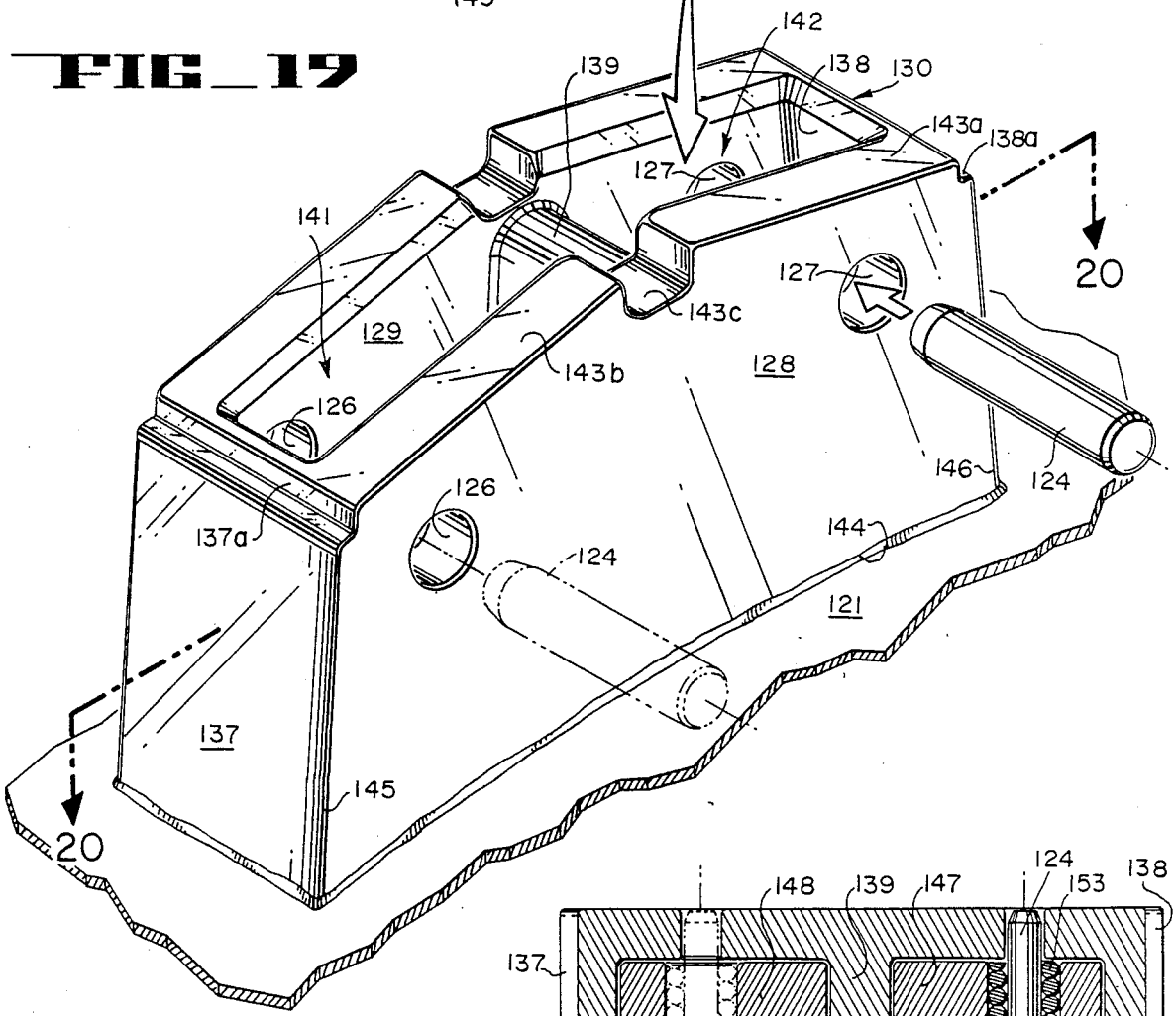
FIG. 20 shows a section view in plan taken along the line 20—20 of FIG. 19 after the upper and lower portions thereof have been assembled together.
Figure 20:
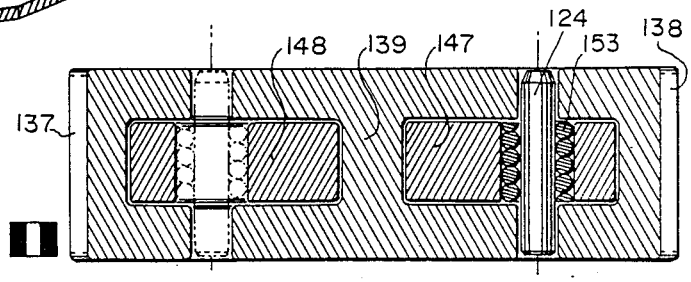
Figure 21:
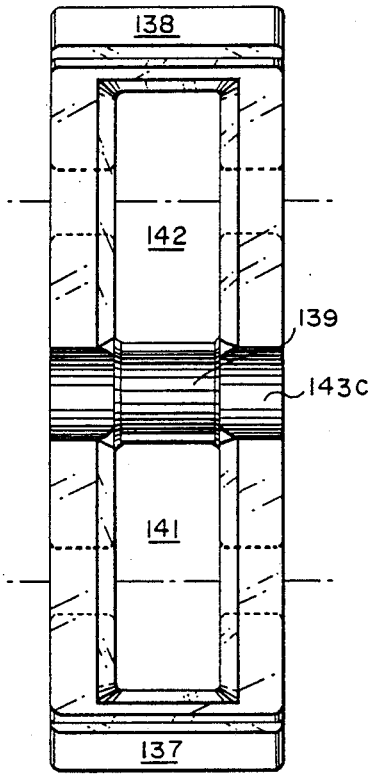
FIGS. 21 and 22 respectively show top and bottom plan views of the mounting show shown as the lower component of FIG. 19.
Figure 22:
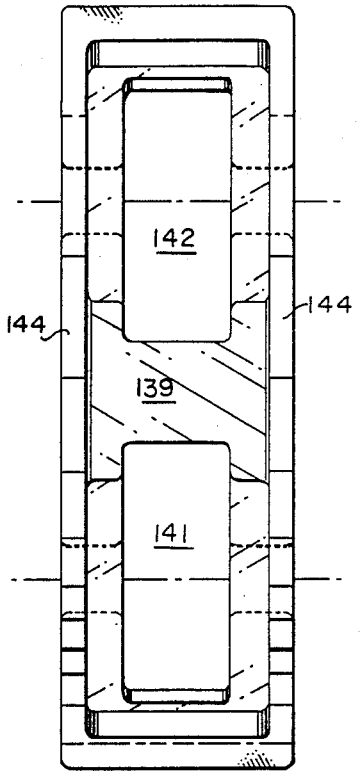
Figure 23:
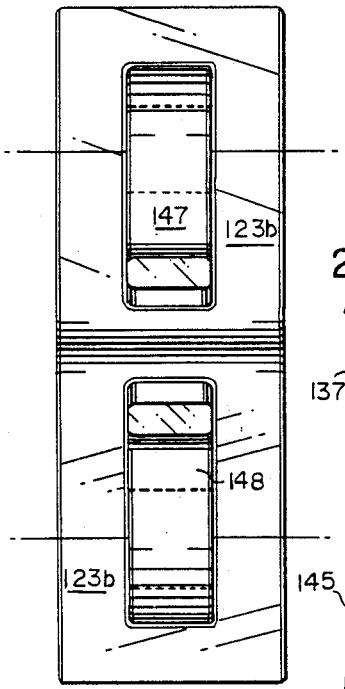
FIG. 23 shows a bottom plan view of a removable cap portion taken along the line 23—23 of FIG. 24.
Figure 24:
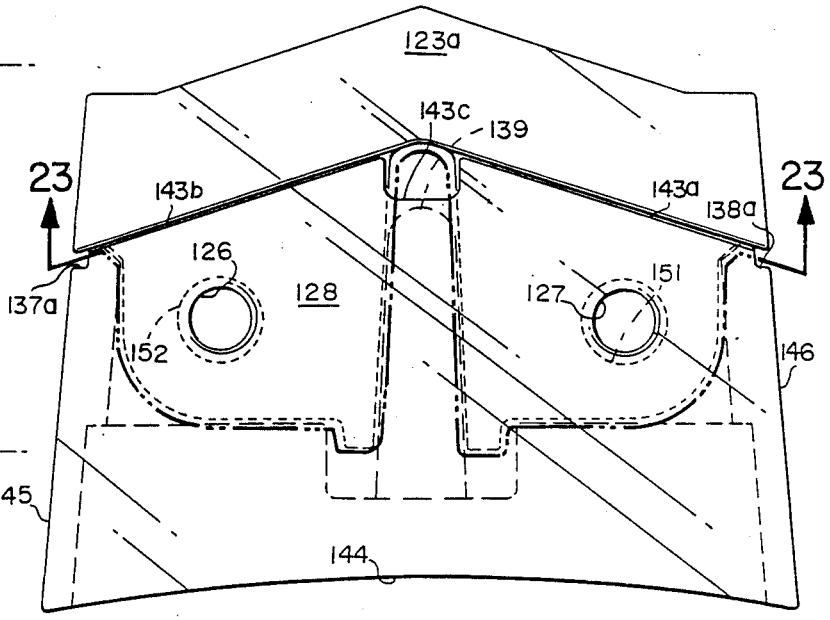
FIG. 24 shows a side elevation view of the cleat assembly shown in FIG. 17.

Each of tongues 147, 148 includes a coupling opening 151, 152. Each of openings 151, 152 is disposed to be aligned with the axis of an associated one of the pair of aligned openings 126, 127 when tongues 147, 148 are fully inserted into their associated pockets 142, 141. Means for readily releasably retaining cap unit 123 secured within shoe 130 includes a coil 153 of spring wire disposed within a selected one of the coupling openings 151, or 152. As shown in FIG. 19 coil 153 is disposed within opening 151. The exterior dimensions of coil 153 correspond substantially to the diameter and length of coupling opening 151, which is identical to coupling opening 152. Further, the thickness of tongues 147, 148 is only slightly less than the thickness of pockets 141, 142 whereby only a minor degree of clearance is to be encountered at the ends of coil 153. The diameter of retaining pin 124 is slightly larger than the diameter of the opening formed through coil 153 whereby after disposing tongues 147, 148 into their associated pockets 142, 141 with at least one of the coupling openings 151, 152 carrying a coil 153, pin 124 can be driven into the center of coil 153 to cause it to expand radially and slightly lengthwise thereby to retain pin 124 within shoe 130.

As shown in FIG. 19 a retaining pin 124 has been shown in phantom lines associated with aligned openings 126 to indicate the option of permitting the operator to employ a pin at either of the two pairs of aligned openings 126, 127 or in the alternative in both sets of aligned openings.

In addition, it has been observed that when using equipment of this kind in certain soils and other conditions materials can become caked within cleat assembly 122 and retain cap unit 123 to shoe 130. Accordingly, an opening in the form of the open notch 143*c* in each of the two side walls 128, 129 has been provided whereby when an operator desires to change from a worn cap unit 123 to a new one, it is possible to break up compacted materials serving to retain cap unit 123. Finally, should it be desired to weld cap unit 123 to the top of shoe 130, grooves 137*a* and 138*a* have been formed to extend across the upper end of end walls 137, 138 and beneath an overhanging lip of cap portion 123*a* (shown best in FIG. 24).

According to another embodiment of the invention, a cleat assembly 154 includes a removable cap unit 156 arranged to be carried by a base assembly 157 in a manner which prevents the cap unit 156 from twisting in use and which minimizes movement of cap unit fore and aft with respect to base assembly 157.

Figure 26:
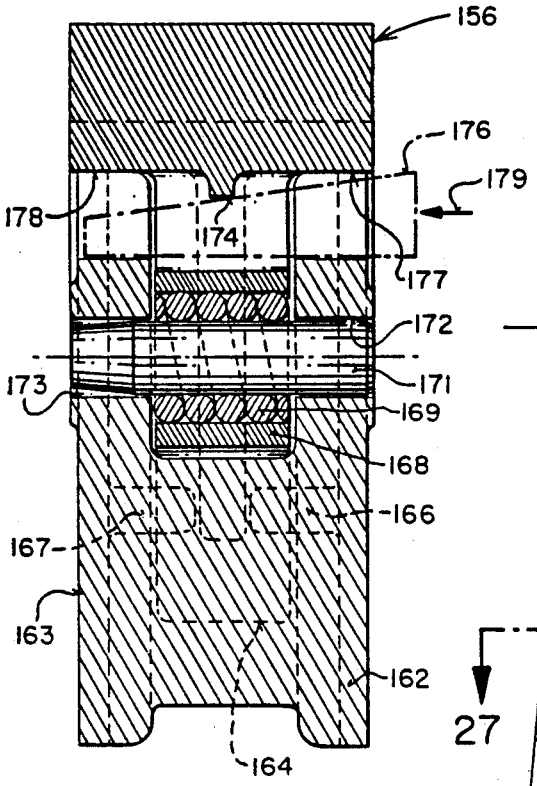
FIGS. 26 and 27 are section views taken along lines 26—26 and 27—27 of FIG. 25.
Figure 25:
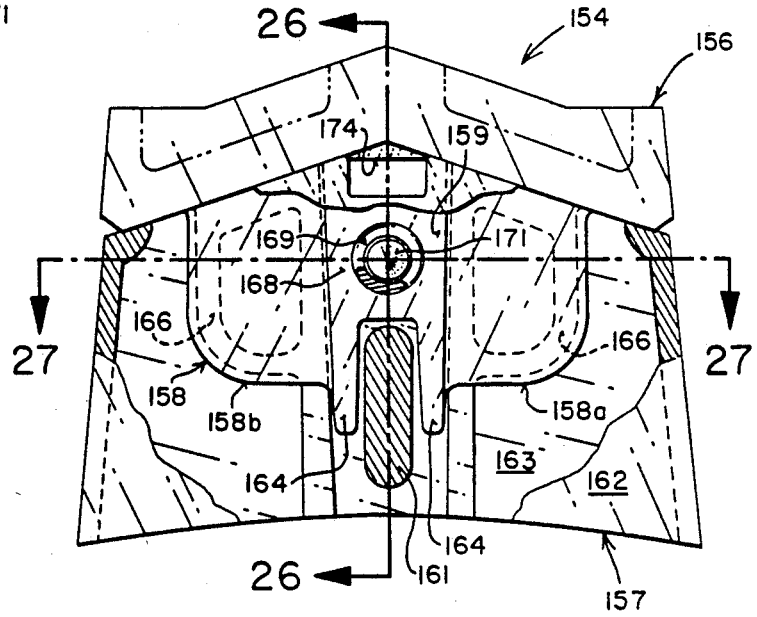
FIG. 25 shows a side elevation view with the front wall broken away for clarity of another embodiment of a cleat assembly according to the invention.
Figure 27:
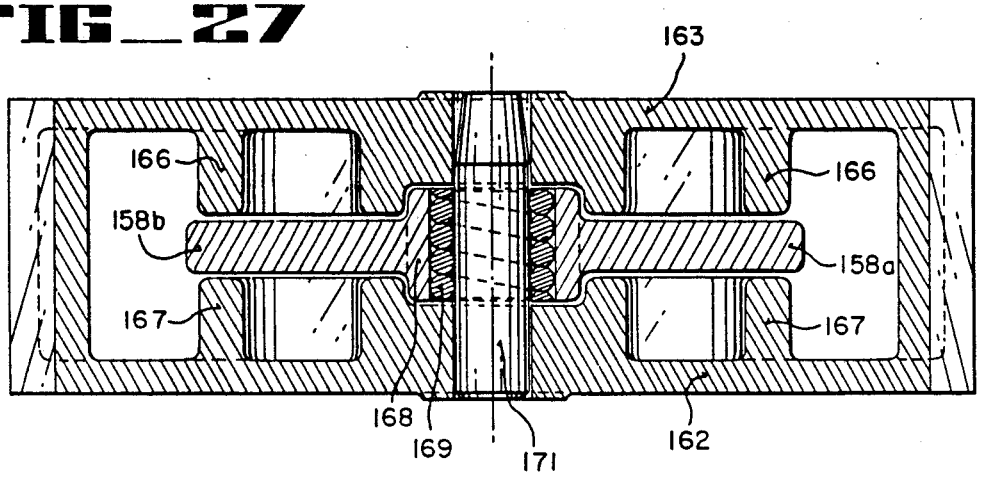
Figure 28:
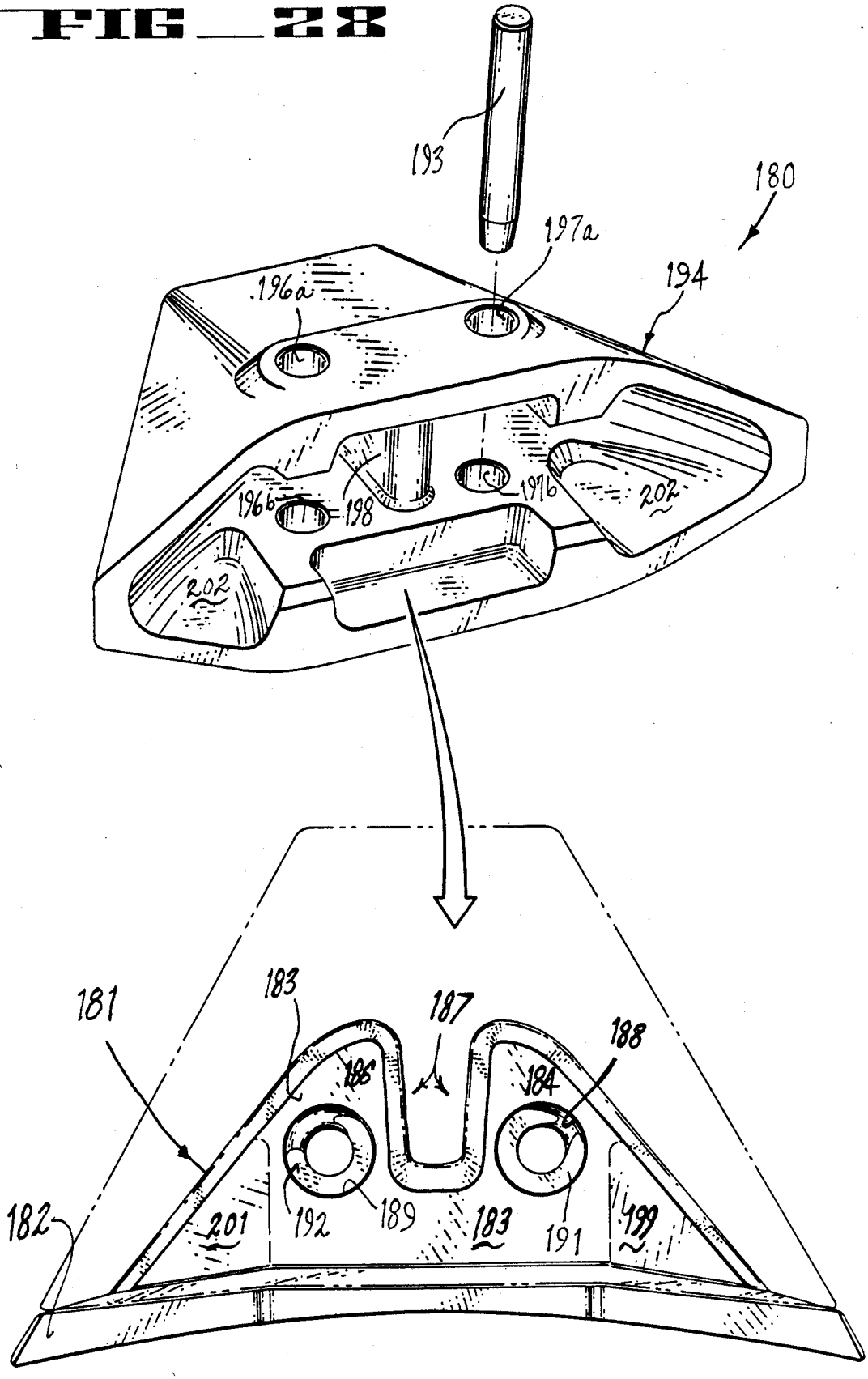
FIG. 28 shows a diagrammatic exploded perspective view of a demolition cleat according to the invention.
Figure 29:
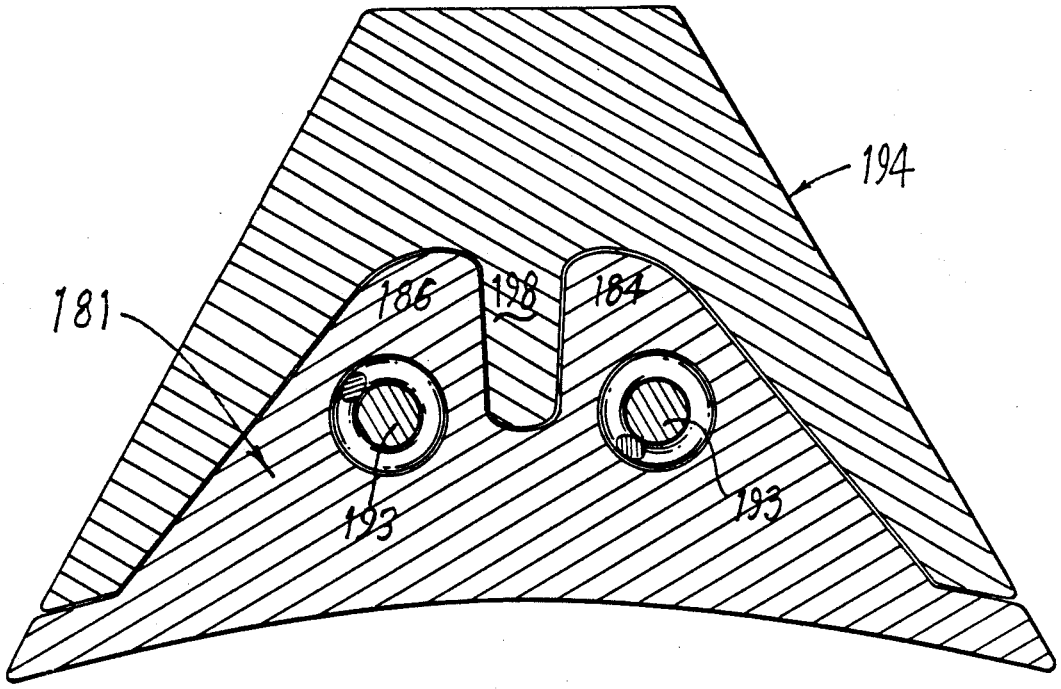
FIG. 29 shows an elevation centerline section view of the cleat of FIG. 28 when assembled onto its associated bracket.
Figure 30:
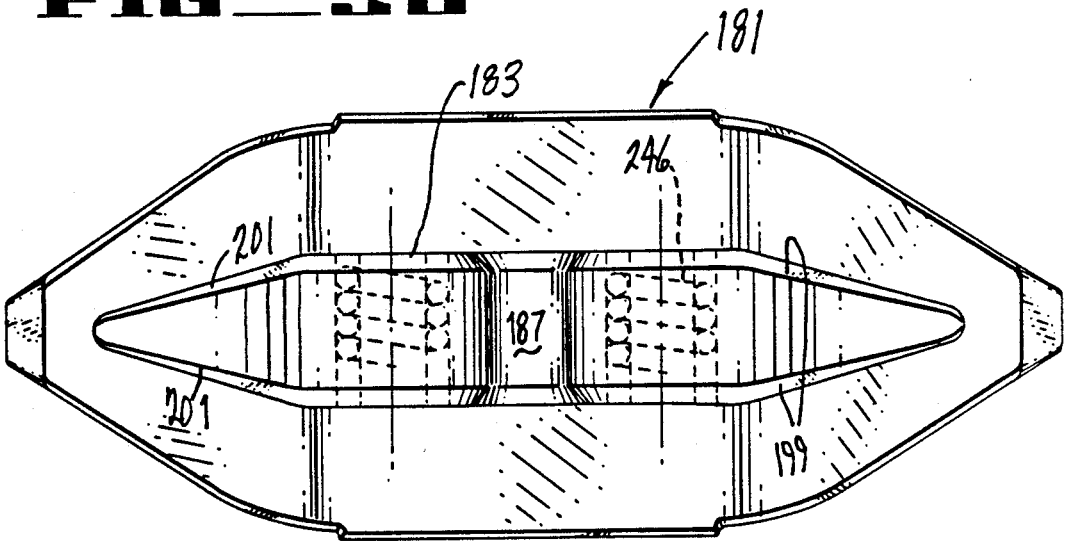
FIG. 30 shows a plan view of the mounting pad assembly shown in FIG. 28.

Base assembly 157 as shown in FIGS. 25–27 can be readily welded to the cylindrical outer surface of a wheel as described above. Cap unit 156 carries a downwardly depending web assembly 158 including an imperforate pair of lobes 158*a*, 158*b* flanking a centrally disposed bracket portion 159.

Base assembly 157 includes a transversely extending tie bar 161 formed integrally with the side wall structure of base assembly 157. Tie bar 161, accordingly, extends between the two confronting side walls 162, 163 to provide additional rigidity therebetween.

In addition, longitudinal movement of cap assembly 156 with respect to base assembly 157 has been inhibited by the presence of a downwardly depending bifurcated fork portion 164 having an opening therebetween to receive and provide a snug fit with tie bar 161 as fork portion 164 passes downwardly over tie bar 161 to seat itself thereon.

Means for inhibiting side play and twisting of cap assembly 156 with regard to base assembly 157 includes the interiorly confronting flanges 166, 167 spaced sufficiently apart to receive web assembly 158 therebetween.

The contact between the confronting sides of fork elements 164 and tie bar 161 provides a snug fit so as to prevent longitudinal movement of cap assembly 156 relative to base assembly 157.

Immediately above fork elements 164 bracket portion 159 has been formed to include a cylindrical housing 168 for containing a wire coil 169 disposed therein to surround a coupling pin 171. Pin 171 preferably is tapered at its entering end whereby as it is driven through openings 172, 173, in side walls 162, 163, the individual convolutions of coil 169 will form a snug fit with the interior side wall of cylindrical housing 168. In this manner, coil 169 will hold onto retaining pin 171 and lock it in a position for retaining cap assembly 156 to base assembly 157.

Cylinder 168 houses coil 169 disposed therein. Coil 169 includes a central opening axially therethrough, while the wire is coiled to lie within an imaginary cylinder. The bitter ends of the wire of coil 169 lie within the imaginary cylinder with sufficient clearance with respect to cylinder 168 to permit coil 169 to be easily slidably inserted into cylinder 169 in closely spaced relation therearound.

It has been observed that when a cleat assembly of the type described is utilized over a significant period of time, cap assembly 154 and base assembly 157 become tightly engaged. To remove and replace cap assembly 156 from base assembly 157, pin 171 is removed by driving it along its axis to be discharged from the cleat assembly. Notwithstanding the removal of coupling pin 171, removal of cap assembly 156 can still remain a problem.

Accordingly, means have been provided for removing cap assembly 156 from base assembly 157 after removal of pin 171. As shown best in FIGS. 25 and 26, cap assembly 156 includes a downwardly depending contact surface 174 lying substantially on a mid-plane of cap unit 156. Accordingly, in order to lift cap unit 156 upwardly out of base assembly 157, a wedge 176 shown in phantom lines in FIG. 26 is disposed to be inserted through the opening 177 of side wall 162 and to extend into an opening 178 in side wall 163 aligned therewith.

As wedge 176 is driven inwardly as indicated by arrow 179, an inclined surface of wedge 176 ultimately engages contact surface 174 to lift cap assembly 156 by forces applied from a mid-plane position therein.

The foregoing arrangement has the singular advantage that in the event that a wedge were to be applied to attempt to lift cap assembly 156 from one side edge or the other the cap assembly would cock and thereby bind cap assembly 156 within base assembly 157.

Finally, as shown in FIG. 26, the maximum upward displacement of cap assembly 156 is limited to the spacing between the top of cylinder 168 and the underside of wedge 176. After wedge 176 has been removed, however, cap assembly 156 can be withdrawn further outwardly.

Accordingly, the embodiment shown in FIGS. 25–27 discloses a pinned-on cap assembly arrangement wherein the cap assembly is firmly secured to base assembly 157 in a manner preventing twisting thereof as well as in a manner inhibiting any significant lateral or longitudinal movement.

Another embodiment of a demolition cleat assembly 180 for attachment to a fill and compaction roller of a type having a rigid annular body includes a rigid mounting assembly 181 having a base portion 182 adapted to be secured to the annular body by suitable means such as welding or the like. Mounting assembly 181 includes a rigid bracket 183 integral to the base portion 182 and disposed to protrude generally radially outwardly from the body.

Bracket 183 includes a pair of lobes 184, 186 spaced in the direction of movement of cleat assembly 180 when attached to the annular rotatable body.

Lobes 184, 186 are formed and spaced to include a transverse notch or slot 187 therebetween.

Each lobe 184, 186 includes a transversely extending coupling pin opening 188, 189, respectively, dimensioned to receive a coiled spring 191, 192 therein as described above in greater detail.

Thus, each spring 191, 192 includes a central opening for receiving a coupling pin 193 therein.

A readily removable shoe or cap unit 194 formed and shaped to define a demolition cleat slides readily over the mounting assembly 181 for attachment thereto.

Shoe 194 includes a generally hollow body having radially outwardly convergent inner and outer side walls. Pairs of aligned openings 196*a*, 196*b*; 197*a*, 197*b*; respectively, are formed through the side walls and disposed to be aligned with coupling openings 188, 189 for receiving a coupling pin 193 therethrough.

A coupling pin 193 disposed through coupling opening 188, (or 189) and the central opening of springs 191, (or 192) serves to retain cap unit 194 to mounting assembly 181. Means for readily releasably locking coupling pins 193 in their respective openings includes the springs 191, 192 which tightly grip the exterior of pins 193 to prevent decoupling of the shoe 194 from mounting assembly 181.

Cleat assembly 180 is further characterized by means restraining twisting of shoe 194 with respect to base portion 182. The restraining means includes a rigid crossbar 198 extending between the inner side walls of shoe 194 so as to strengthen the structure of shoe 194. Crossbar 198 is dimensioned to slide snugly into slot or notch 187 and be restrained thereby.

In short, the elongate bracket 181 protrudes generally radially outwardly from base portion 182 which is formed integral to the bracket. 181. Bracket· 181 is formed with radially outwardly convergent side walls 199, 201 at each end thereof and tapered downwardly and away from each other thereat. Note, for example, the sloping ends of bracket 181.

Furthermore, cap unit 194 includes interior seating surfaces 202 at opposite ends thereof for engaging the outwardly convergent side wall portions 199, 201 of bracket 181 in order to provide a snug fit between bracket 181 and cap unit 194. Finally, means for readily releasably coupling the bracket and cap unit together includes the coupling pin 193 and associated coil spring 191 (or 192) disposed in an opening 188 (or 189).

Figure 34:
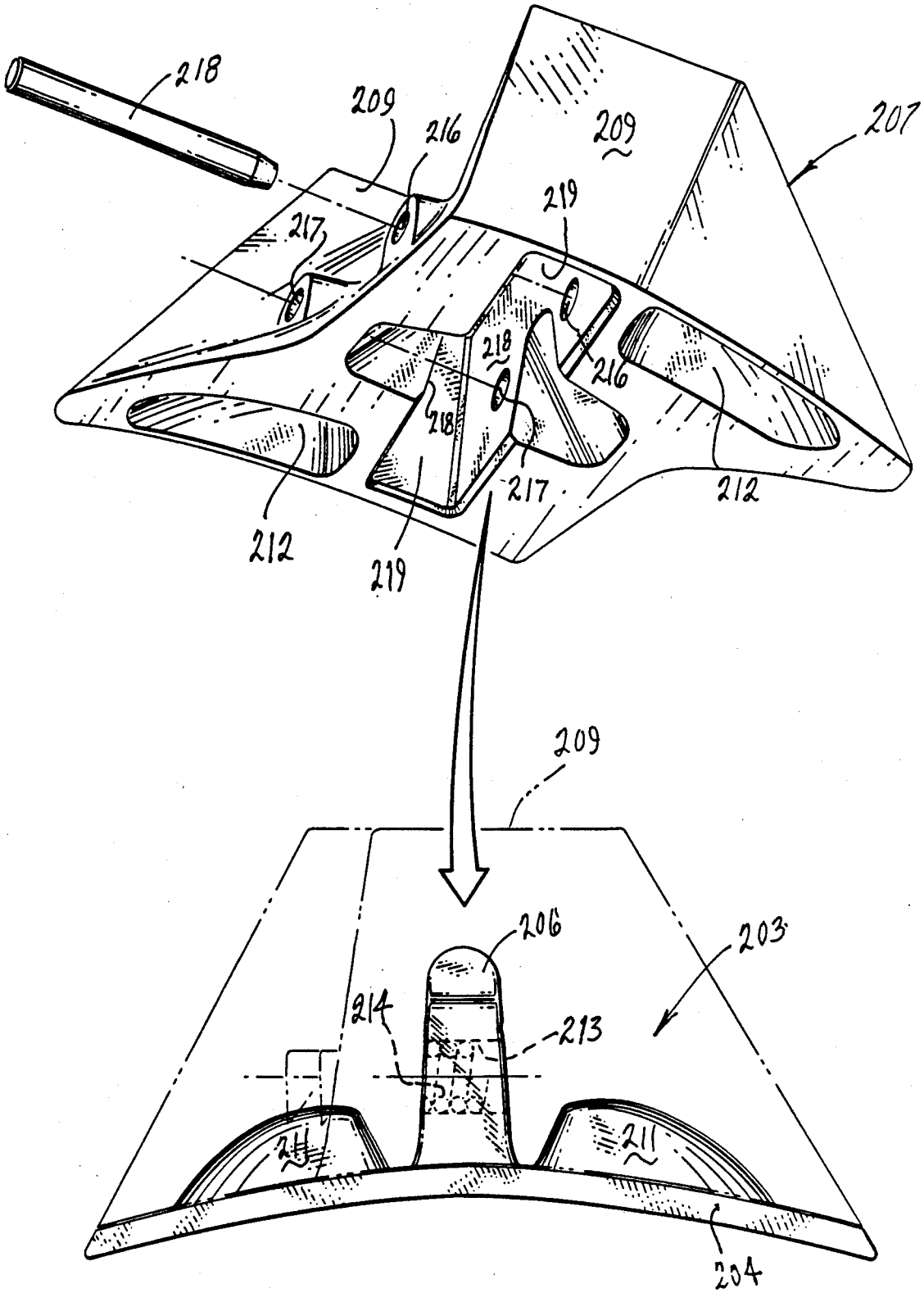
FIG. 34 shows a diagrammatic exploded perspective view of a combined traction and demolition cleat assembly.
Figure 35:
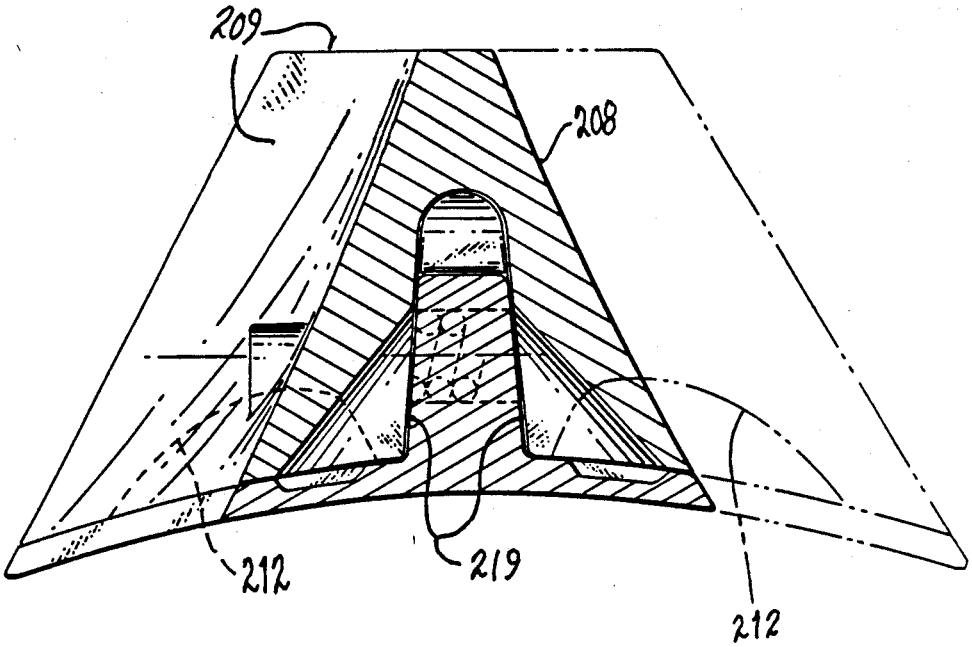
FIG. 35 shows a centerline section view of the assembly shown in FIG. 34.
Figure 36:
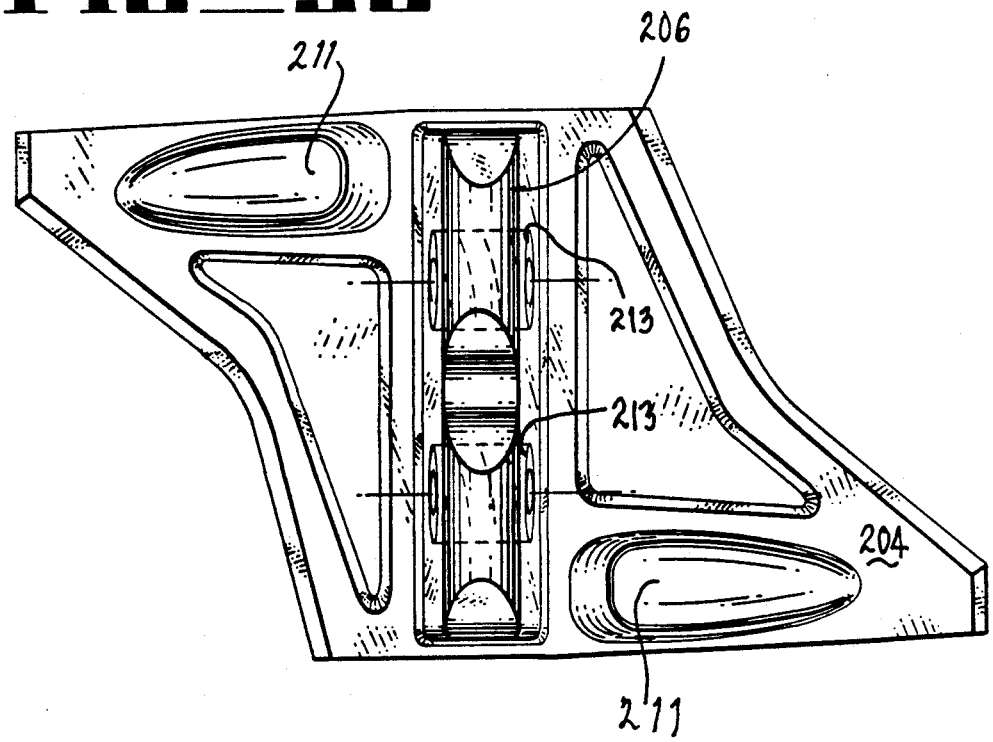
FIG. 36 shows a diagrammatic plan view of the base portion of the assembly shown in FIG. 34.
Figure 37:
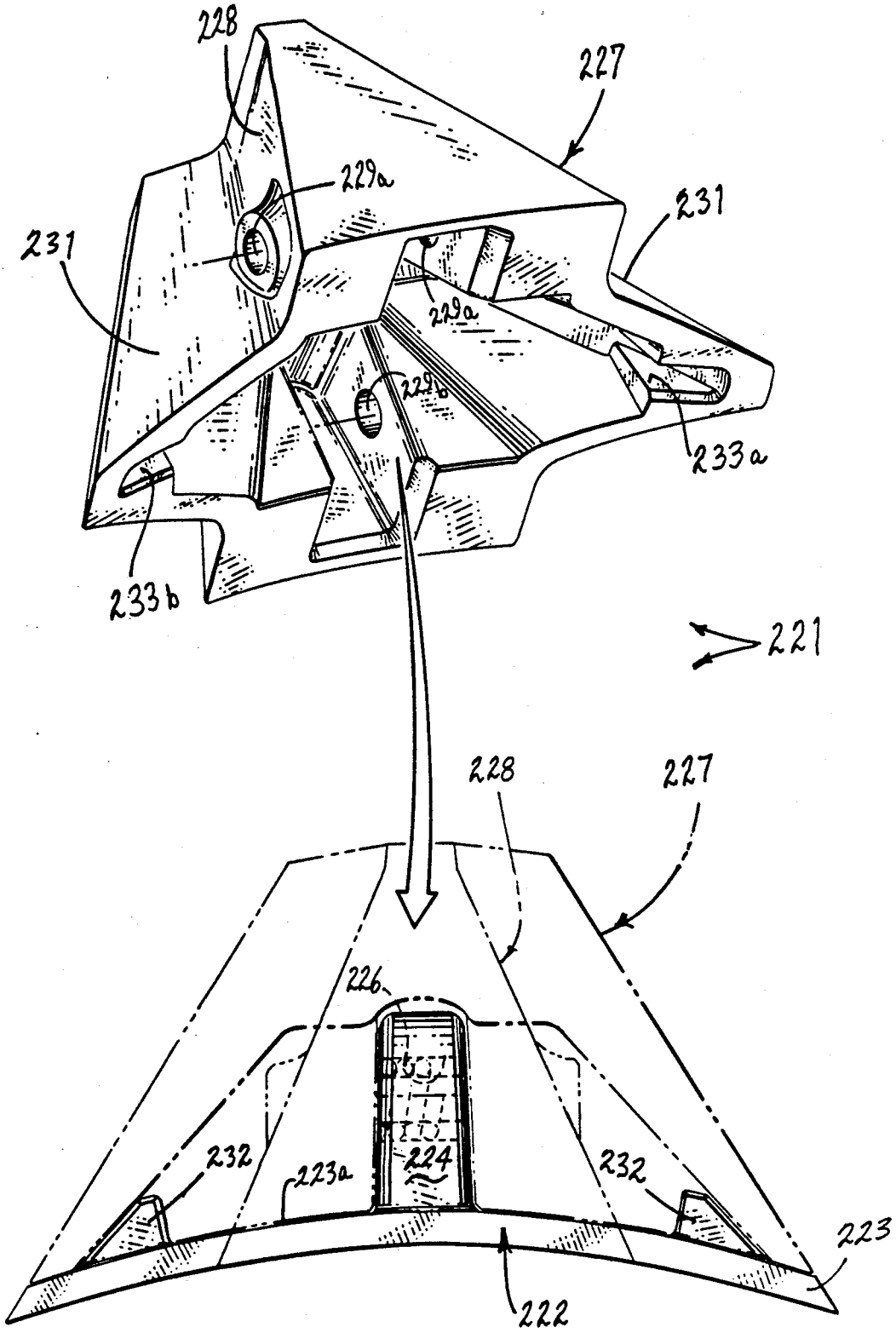
FIG. 37 shows a diagrammatic exploded perspective view of a combined traction and demolition blade cleat assembly according to the invention.

In general, as shown in FIG. 34 and FIG. 37 other embodiments of a cleat assembly for a fill and compaction roller comprises a rigid mounting pad assembly 203 having a base portion 204 adapted to be welded to an annular body such as a rigid wheel employed by tractors.

An elongate bracket 206 formed integral to base portion 204 protrudes generally radially outwardly therefrom and crosswise of the direction of movement of the cleat assembly. A hollow removable shoe unit 207 is formed to include both a traction cleat portion 208 and a demolition cleat portion 209 disposed transversely of traction cleat portion 208. Means serving to prevent or inhibit twisting of shoe unit 207 with respect to base portion 204 includes, in addition to bracket 206, male and female portions 211, 212 respectively carried by base portion 204 and shoe unit 207 and disposed to cooperate with each other to inhibit twisting of shoe unit 207 about an axis substantially normal to base portion 204.

Means for coupling the base mounting pad assembly 203 to shoe unit 207 comprises bracket 206 formed with a pair of laterally spaced apart coupling pin openings 213 containing relatively stiff and large coil springs 214 therein. A pair of laterally spaced apart aligned openings 216, 217 serve to receive a coupling pin 218 therethrough. Accordingly, as coupling pin 218 is driven into openings such as 216, it enters the central opening to spring 214 and expands same so as to firmly retain coupling pin 218 in its inserted position.

As thus arranged, cap unit 207 has a hollow interior formed to include a pair of spaced confronting walls forming immovable jaw means 218 carried by the interior of cap unit 207 and defining a slot 219 therebetween for receiving bracket 206 therein.

Figure 38:
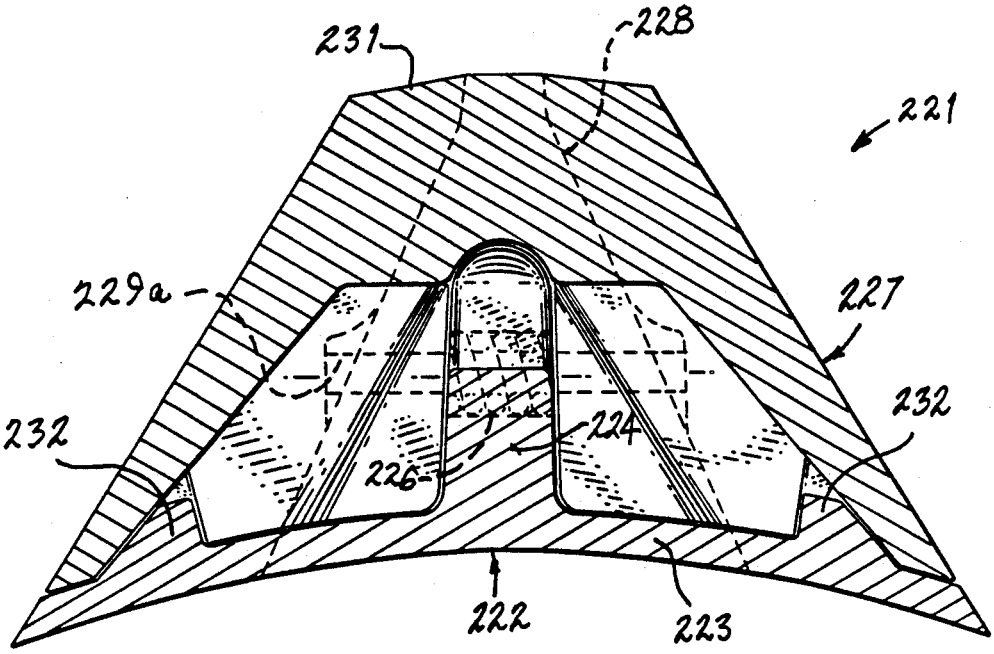
FIG. 38 shows a side elevation centerline section view of the cleat assembly in its assembled condition as shown in FIG. 37.
Figure 39:
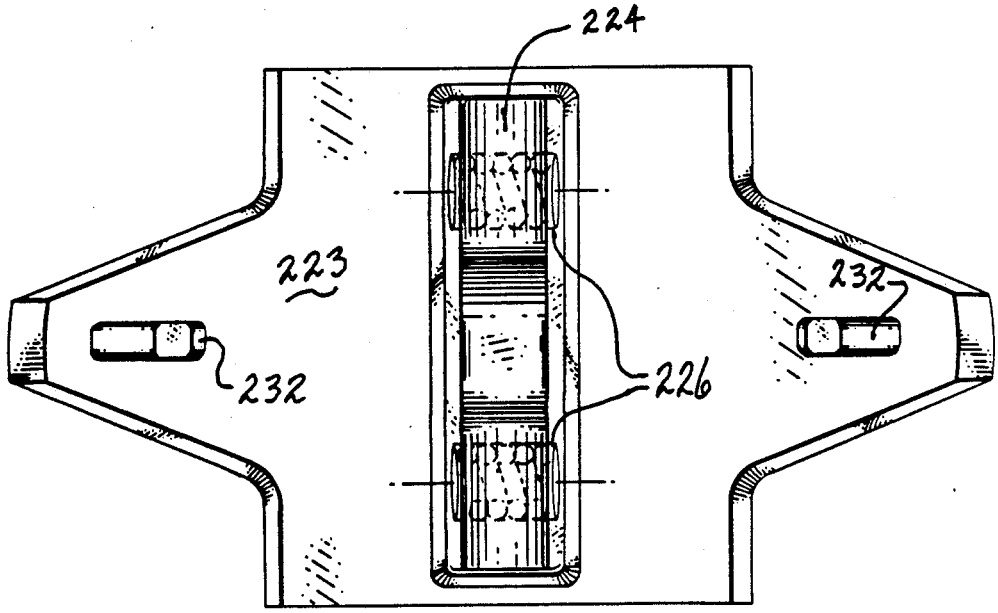
FIG. 39 shows a plan view of the base portion of the cleat assembly shown in FIG. 38.

According to another embodiment as shown in FIGS. 37, 38 and 39, a cleat assembly 221 comprises a rigid mounting pad assembly 222 having a base portion 223 to be welded to a rigid cylindrical roller or body supported for rotation from a vehicle chassis. Base portion 223 supports a bracket 224 integral to the base portion 223 protruding generally radially outwardly therefrom and crosswise to the direction of movement of cleat 221 when secured to a roller, wheel or other rigid cylindrical body. Bracket 224 includes a plurality of coupling openings 226 extending transversely through bracket 224 in laterally spaced relation.

A detachable cap unit 227 includes a traction blade portion 228 having a plurality of pairs of aligned openings 229 disposed in alignment with the spaced coupling openings 226 through the bracket. Cap unit 227 further includes demolition blade means 231 integral with and extending crosswise of the plane of traction blade means 228. Finally, means carried by base portion 223 protrude upwardly therefrom for engaging cap unit 227 so as to inhibit twisting of cap unit 227 with respect to base portion 223. More particularly base portion 223 includes a pair of generally triangularly shaped detents 232 integral with the exposed surface 223*a* of base portion 223. Shoe or cap unit 227 includes a pair of spaced notches 233*a*, 233*b* for receiving detents 232 therein. Shoe or cap unit 227 is mounted on base portion 223. Detents 232 are engaged within the notches to inhibit twisting of shoe 227 about an axis substantially normal to base portion 223.

Figure 31:
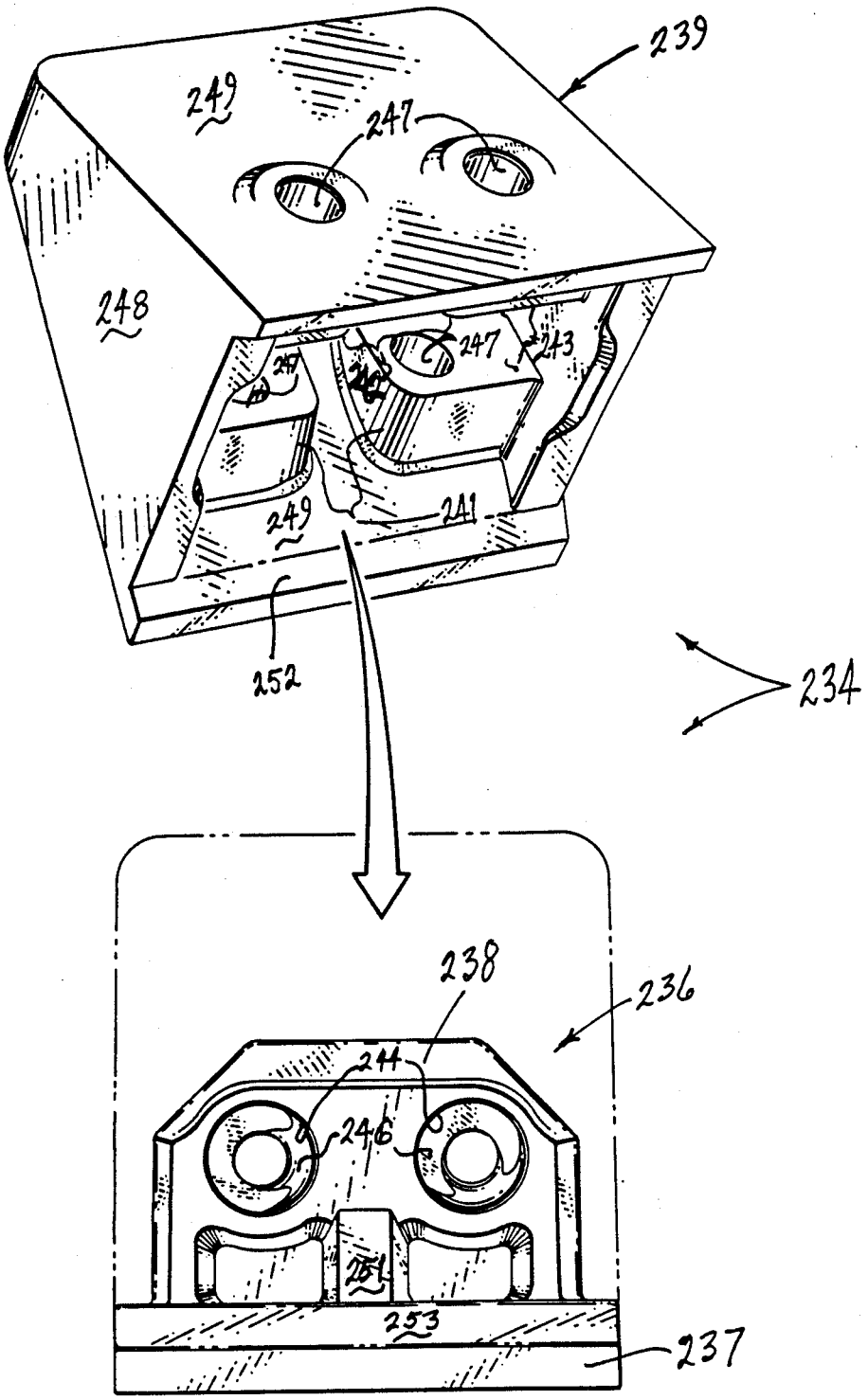
FIG. 31 shows a diagrammatic perspective exploded view of a traction cleat according to the invention.
Figure 32:
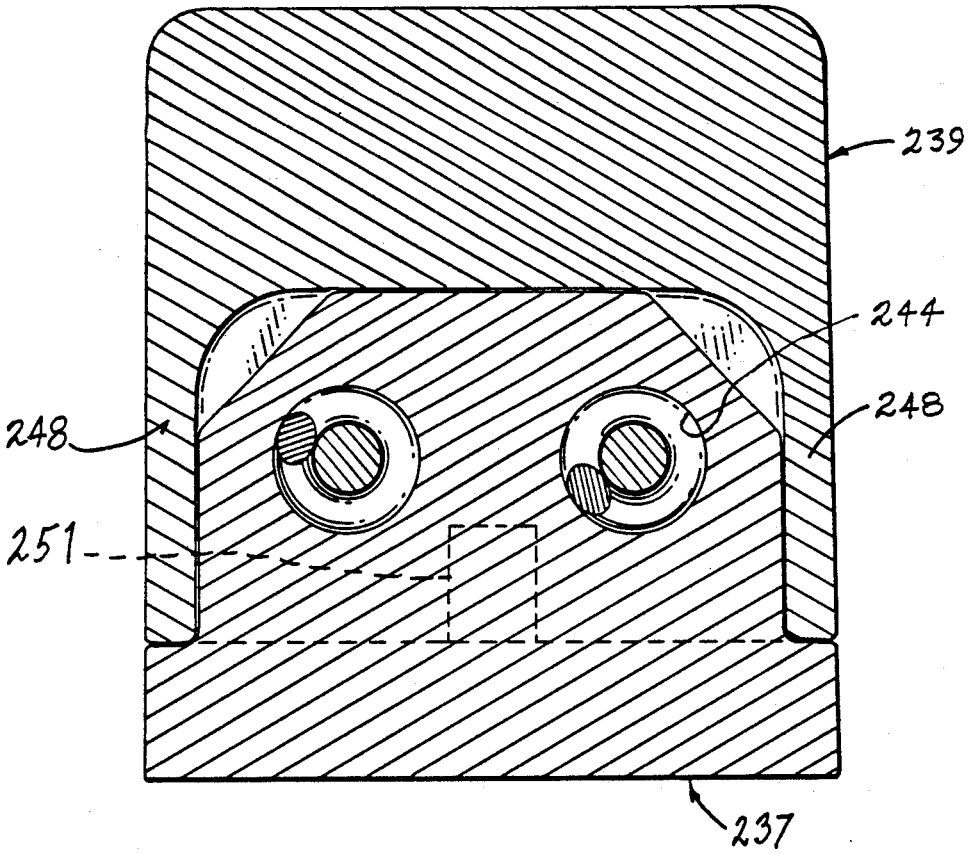
FIG. 32 shows an elevation transverse centerline section view of the traction cleat assembly shown in FIG. 31.
Figure 33:
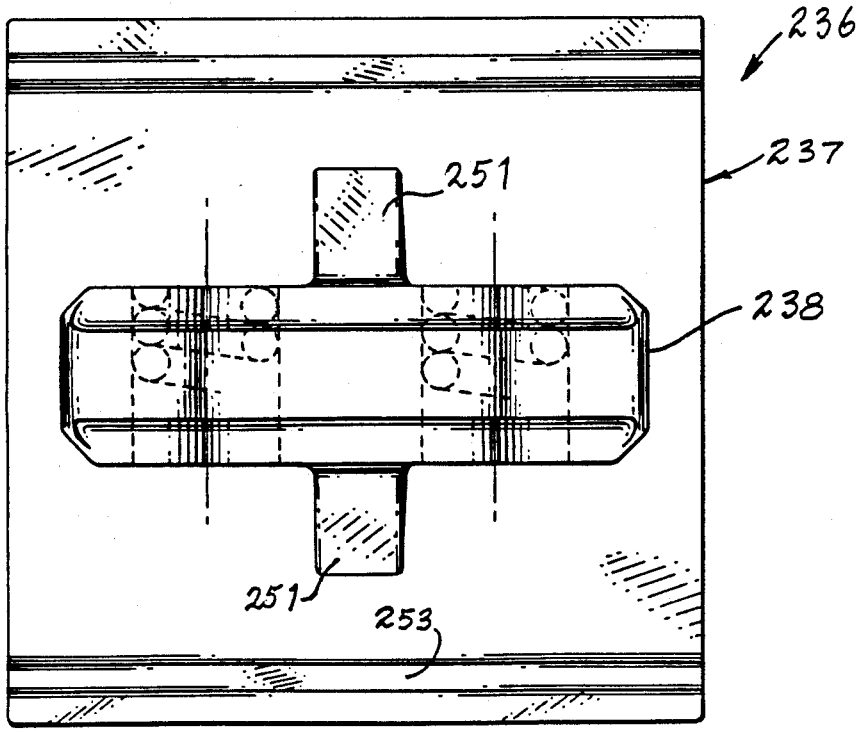
FIG. 33 shows a diagrammatic plan view of the lower bracket portion of the traction cleat assembly shown in FIG. 31.

According to another embodiment primarily useful for a traction cleat, and as shown best in FIG. 31, a traction cleat assembly 234 comprises a rigid mounting pad assembly 236 having a base portion 237 adapted to be welded to a cylindrical rigid body. Mounting pad assembly 236 further includes a bracket 238 formed integral to base portion 237 and protruding generally radially outwardly therefrom when carried on the rigid annular body. Bracket 238 is disposed in an imaginary plane lying on a radius of the body and originating centrally of that body.

A cap unit 239 has a hollow interior formed to include a pair of spaced confronting immovable jaw means 241, 242 carried by the interior of cap unit 239. The spacing between jaw means 241, 242 serves to define a slot 243 therebetween for receiving bracket 238 therein. A pair of elongate coupling openings 244 extend transversely through bracket 238 and contain elongate coupling springs 246 aligned with coupling pin openings 247. Cap unit 239 includes sloping radially outwardly converging side walls 249 and transverse end walls 248 extending between the end edges of side walls 249.

Bracket 238, while integral with base portion 237 has been reinforced by the presence of braces 251 extending transversely of bracket 238 and integral to both bracket 238 and base portion 237. Each jaw means 241, 242 has been bifurcated or subdivided to provide a space therebetween serving to receive an associated one of braces 251.

In this way, when cap unit 239 has been applied onto mounting pad assembly 236, bracket 238 will fit snugly between the two jaw means 241, 242 and braces 251 will slide snugly between the pair of spaced jaw portions on each side of bracket 238 so as to inhibit twisting of cap unit 239 with regard to mounting pad assembly 236.

The bottom edge margin 252 of side walls 249 are formed and disposed to rest snugly on the tapered surfaces 253 of base portion 237. As so placed, cap unit 239 will fit snugly onto base portion 237 and be restrained from twisting both by the presence of bracket 238, and by virtue of the edge margin 252 cooperating with beveled surface 253.

Figure 17:
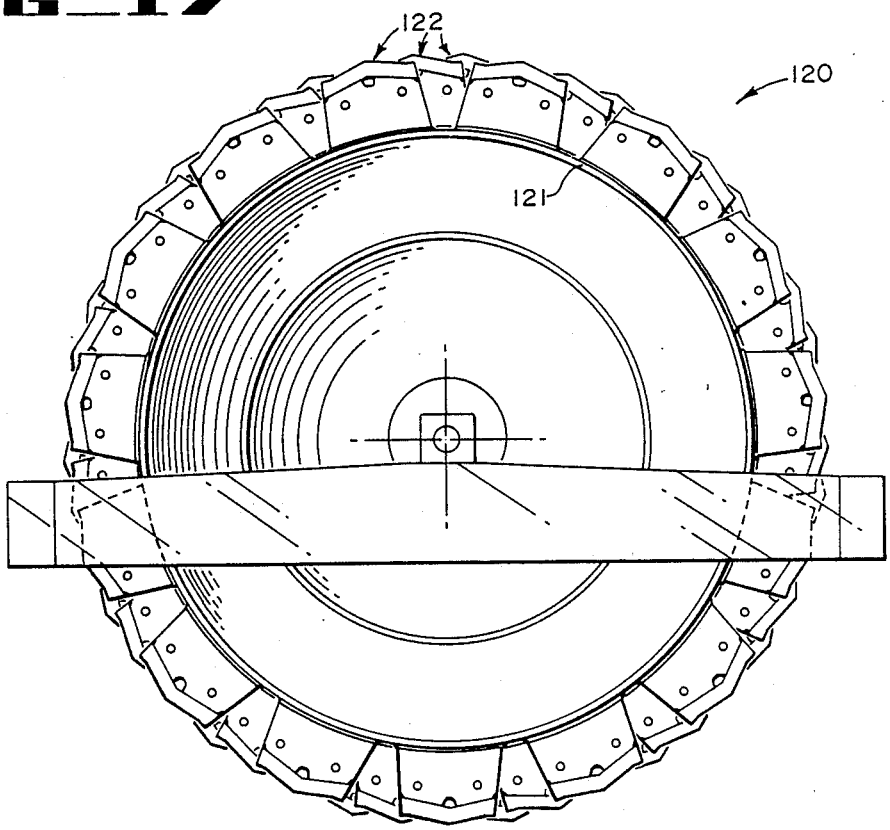
FIG. 17 shows a side elevation diagrammatic view of a fill and compaction roller according to another embodiment of the invention.

As noted and referred to with regard to FIGS. 17 and 18 by offsetting the cleats as shown, it was possible to provide a reasonably clear path for a hammer or other tool in dislodging a coupling pin from the shoe unit. With respect to the embodiments shown in FIGS. 31 through 39, these embodiments also can be offset with respect to the center plane of the annular wheel or body to which they are attached so as to accomplish the same purpose of permitting a free path for a hammer to strike a coupling pin retaining the cleat to its mounting pad assembly.

Figure 40:
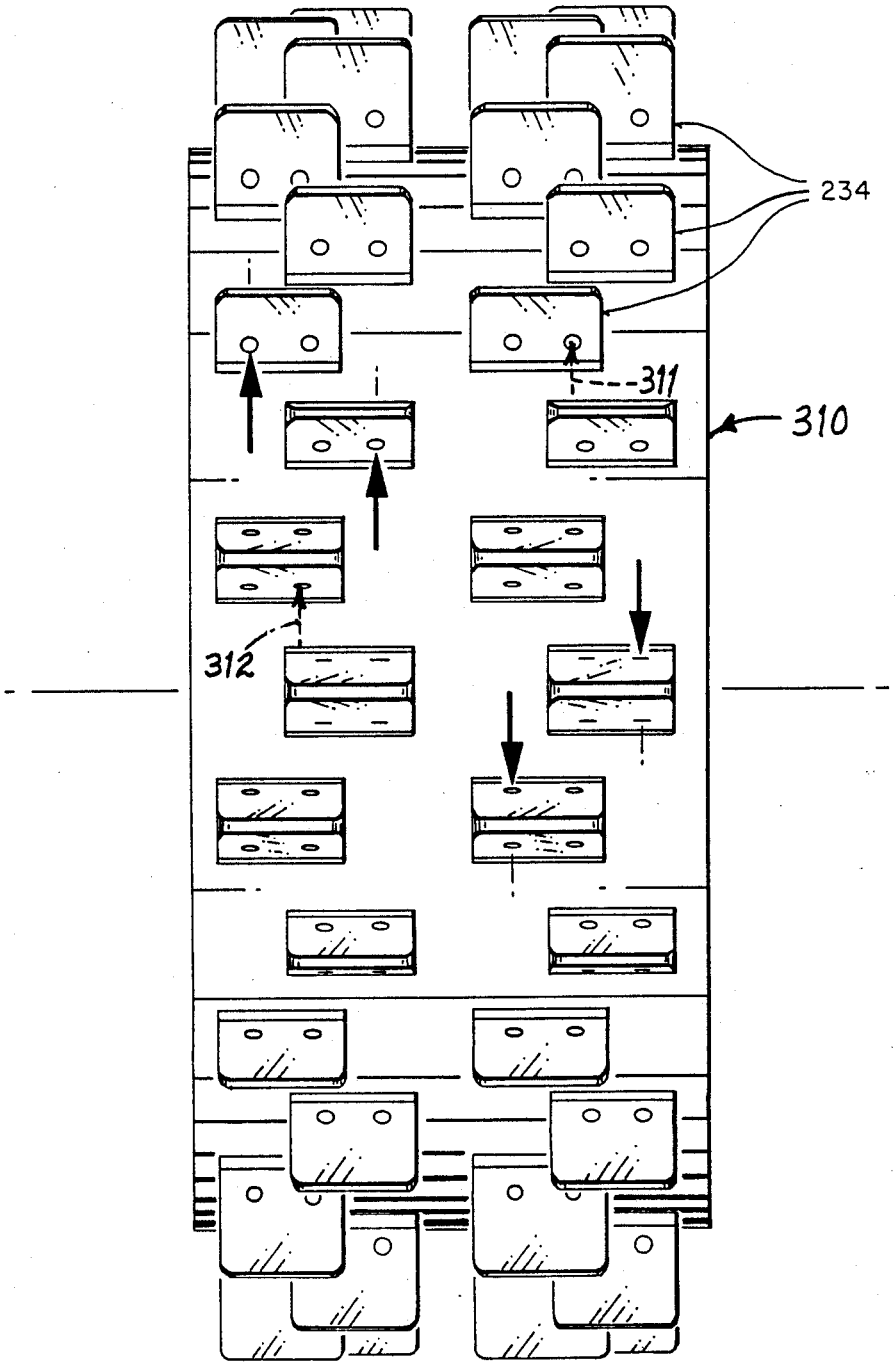
FIG. 40 shows a diagrammatic plan view of a roller portion for explanation.

Thus, the location of these traction cleats on a wheel can be alternately staggered therearound as shown in FIG. 40 and attached using only a single pin.

The main reason for utilizing two positions for inserting a retaining pin into each of the cleat assemblies disclosed above has been described above with regard to FIGS. 17 and 18. With respect to cleat assembly 234 shown in FIG. 31, the diagram shown in FIG. 40 explains how cleat assemblies 234 can be staggered around the rim of a rigid steel wheel 310. Thus, the solid line arrows are shown in regions where there is a relatively clear path for use of a hammer or other type of tool in driving a punch or screwdriver to dislodge the retaining pin. Arrows in phantom line such as shown at 311, 312 represent positions of the retaining pins which are relatively inaccessible since the position of an adjacent cleat assembly 234 tends to block the free pass of a hammer or other tool used to dislodge the retaining pin.

From the foregoing, it will be readily evident that there have been provided improved cleat assemblies for fill and compaction rollers whereby the wear caps can be readily replaced before damage is done to the mounting pad assembly supporting the wear cap. It will further be evident that means for readily coupling the wear cap to the mounting base permits compacted or caked materials surrounding the coupling pin to be readily broken up in response to striking the pin from one end. Thus the use of a coiled spring wire causes the convolutions of the wire to slightly separate in response to such impact and in this manner provide sufficient relative movement within the coupling opening so as to break up the compacted cake of material therein.

We claim:

1. A fill and compaction roller of a type having a rigid cylindrical body supported for rotation from a vehicle chassis and having cleat assemblies carried by the body, the cleat assemblies each comprising a rigid mounting pad assembly having a base portion welded to said body and a bracket integral to said base portion protruding generally radially outwardly therefrom, a coupling opening extending transversely through said bracket, a detachable cap unit readily releasably coupled to said base portion, said cap unit having a generally hollow body including sloping upwardly converging outer side walls extending radially outwardly sufficiently in a given direction to substantially meet and define a longitudinal blade therebetween, and transverse end walls extending between the end edges of said side walls, a length of coiled spring wire disposed within and along the axial length of said coupling opening, said coiled spring wire having a central opening axially thereof, said wire being coiled to lie within an imaginary cylindrical configuration, both ends of said wire lying within said imaginary cylinder to permit said spring to be easily slidably inserted into said coupling opening in closely spaced relation therearound, a pair of aligned openings respectively formed through the side walls and aligned with said coupling opening and said central opening of said coiled spring wire for receiving a coupling pin therethrough, a coupling pin disposed through said coupling opening, said coiled spring wire, and said aligned openings to cause said length of coiled spring wire to engage said pin in a manner to retain said cap unit to said mounting pad assembly, said coiled spring wire readily releasably locking said pin in said openings to prevent decoupling of said cap unit from said pad assembly, while permitting the spring to elongate when said pin is struck by a hammer, such elongation serving to break up caked soil thereon otherwise inhibiting removal of said cap unit.

2. A cleat assembly for attachment to a fill and compaction roller of a type having a rigid annular body, said assembly comprising a rigid mounting pad assembly having a base portion adapted to be welded to the body and a bracket integral to said base portion protruding generally outwardly therefrom, a coupling opening extending transversely through said bracket, a cap unit adapted to be readily releasably coupled to said base portion, said cap unit having a generally hollow body including radially outwardly convergent inner and outer side walls, a pair of aligned openings respectively formed through the side walls and disposed to be aligned with said coupling opening for receiving a coupling pin therethrough, a coupling pin disposed through said coupling opening and said aligned openings to retain said cap unit to said mounting pad assembly, and means for readily releasably locking said pin in said openings to prevent decoupling of said cap unit from said pad assembly, said cleat assembly being characterized by means restraining twisting of said cap unit with respect to said base portion, said means restraining twisting of said cap unit including seating surfaces slating downwardly and away from opposite ends of said bracket and carried by said base portion and said bracket, a pair of confronting substantially parallel abutments protruding from and extending radially outwardly along said inner walls of said cap unit, the radially inner free edges of said abutments being bevelled to correspond to the configuration of and to engage said seating surfaces carried by said base portion and said bracket, said means restraining twisting further including flanges extending along a pair of parallel side edges of said base portion, tapered side surfaces of said base portion formed to extend upwardly from said flanges to the level of the top surface of said base portion, transverse end walls extending between the end edges of said side walls and depending sufficiently to engage said base portion, said side walls of said cap unit protruding downwardly beyond said end walls and top of said base portion at an angle to snugly fit alongside said tapered side surfaces while the ends of said side walls engage said side flanges to provide support therebetween.

3. A cleat assembly for crushing, breaking and grinding trash materials comprising a rigid, elongate mounting base adapted to be welded to a rigid annular rotatable body, said base being formed to include an elongate, relatively thin aligning guide formed integrally with said base and oriented on said body to extend in the direction of rotation of said body, the ends of said guide being formed to slope downwardly toward said base and mutually away from each other, said guide extending lengthwise of said base substantially in a mid-plane thereof protruding generally radially outwardly from said base in a plane including the ends of said aligning guide, means forming an elongate removable wear cap having a hollow interior formed to include notches at each end for receiving said ends of said guide therein and serving to restrain twisting of said wear cap relative to said base about an axis normal thereto, and means for readily releasably coupling said wear cap to said base, said elongate base including raised registration surface portions protruding upwardly at each end of said base, and corresponding relieved surface portions defined within the inner edge margin of said cap unit serving to register with said raised surface portions to further restrain said twisting of said wear cap.

4. A cleat assembly for attachment to a fill and compaction roller of a type having a rigid annular rim, said assembly comprising a rigid arcuate shoe adapted to be welded to said rim, said shoe having a broadened radially outer surface formed to include a shallow pocket extending across and along said outer surface, a rigid mounting pad having a base portion and a bracket integral to said base portion protruding away from said radially outer surface, said base portion being disposed within said pocket, weldments joining the ends of said base portion to said shoe, a cap unit formed and disposed to cover said bracket and overlie said weldments in protective relation, and means coupling said cap unit to said bracket for readily releasably retaining said cap unit thereto in such protective relation.

5. A cleat assembly for attachment to a fill and compaction roller of a type having a rigid annular rim, said assembly comprising a rigid shoe adapted to be welded to said rim, said shoe having a pair of side walls disposed in spaced confronting relation, a pair of end walls and a rigid partition intermediate said end walls and extending between said side walls to define a pair of laterally adjacent pockets, said partition serving to strengthen the spacing between said side walls, said side walls as viewed in side elevation having the general shape of a trapezoid including top, bottom and end edges, the bottom edges of said shoe being arcuately formed to conform to the curvature of said rim to permit said shoe to be welded snugly thereto, the upper edge of each said side wall being inclined gradually upwardly from each end wall and including a notch formed therein, said upper edges of said shoe forming a seat for supporting a wear cap disposed thereon, means forming a readily replaceable wear cap unit carried by said shoe, said wear cap unit being formed as an integral unit having a cap portion adapted to engage the ground or other surface supporting the fill and compaction roller, the underside of said cap portion having a surface formed and disposed to mate with and be seated upon the inclined portions of said upper edges of said shoe, and means for readily releasably coupling said wear cap unit to said shoe, the last named said means comprising a pair of elongate, rigid tongues integral with said cap unit and lying substantially in a mid-plane of said cap portion and spaced longitudinally apart to form an elongate mounting slot therebetween, said slot serving to receive said partition therein in supporting relation therebetween when said tongues are disposed into said pockets formed within said shoe, a first pair of aligned openings formed through each of said side walls in a position for passing a locking pin through a first of said pockets, a second pair of aligned openings formed through said side walls in a position for passing a locking pin through a second of said pockets, a coupling opening in each said tongue disposed to be aligned with an associated one of said pairs of aligned openings when said tongues are fully inserted into their associated pockets, a coil of spring wire disposed within a selected one of said coupling openings, and a locking pin disposed through said coil and one of said pairs of aligned openings to retain said wear cap unit to said shoe, the exterior dimensions of said coil corresponding substantially to the diameter and length of the coupling opening.

6. A cleat assembly for attachment to a fill and compaction roller of a type having a rigid annular rotatable rim, said assembly comprising a rigid hollow base having a broad outer end formed and defined by the outer edges of a pair of confronting side walls spaced apart by rigid panels at the leading and trailing ends of said base, said base being adapted to be welded to the rim, a single wear cap unit carried by said base, means for readily releasably coupling said wear cap unit to said base, the last named said means including first openings extending transversely through a leading portion of said base and second openings extending transversely through a trailing portion of said base, said wear cap unit including first and second broad elongate tongues of rigid material to be interposed between said confronting side panels in spaced substantially parallel relation with respect to said confronting side walls, said tongue portions being integral thereto to be disposed into said base between the confronting sides thereof, each said tongue portion having a coupling opening therethrough disposed to be aligned with an associated one of said first and second openings, a coupling pin selectively positionable into said first or second openings through an associated one of said coupling openings for retaining said cap unit to said base.

7. A fill and compaction roller comprising a rigid annular rim having a broad tread surface for engaging a support surface such as the ground, a plurality of cleat assemblies accoding to claim 6 welded to said annular rim and distributed in a plurality of rows thereof disposed in laterally spaced relation across said rim, cleat assemblies of one row being longitudinally offset with respect to those of and adjacent row sufficiently to dispose said first or second coupling openings of each said cleat assembly in said one row into an imaginary plane radially disposed intermediate pairs of said cleat assemblies of a laterally adjacent row to define an unobstructed path extending from said first or second opening thereof across said adjacent row via a spacing between successive cleat assemblies of said adjacent row so as to permit a coupling pin carried in said coupling opening to be more clearly struck for dislodging said pin.

8. In a fill and compaction roller of a type having a rigid cylindrical body supported for rotation from a vehicle chassis and having cleat assemblies carried by the body, the cleat assemblies comprising a hollow, rigid base unit having confronting side walls and end walls extending between the end edges of said side walls, said side walls carrying protruding flanges therefrom to define pairs of spaced apart confronting portions defining gaps therebetween lying substantially on a mid-plane disposed lengthwise of said base; and rigid tie bar extending between said confronting side walls to add rigidity to said base, a cap unit having a closure portion to be disposed across the open outer end of said base unit, a rigid web lying in a mid-plane disposed lengthwise of said closure portion to closely fit within said gaps in a manner inhibiting twisting of said closure portion with respect to said base unit, said web including a forked portion depending therefrom for receiving said tie bar therein with a sufficiently snug fit to inhibit movement of said cap unit lengthwise relative to said base unit.

9. In a fill and compaction roller according to claim 8 in which said cap unit includes a downwardly depending contact surface lying substantially in the mid-plane of said cap unit, and access openings in said base unit adapted to permit an elongate wedge to enter and engage said contact surface so as to urge said cap unit outwardly from said base unit while applying a lifting force to the mid-plane of said cap unit.

10. A cleat assembly for attachment to a fill and compaction roller of a type having a rigid annular body, said assembly comprising a rigid mounting pad assembly having a base portion adapted to be welded to the body and a bracket integral to said base portion protruding generally outwardly therefrom, a coupling opening extending transversely through said bracket, a cap unit adapted to be readily releasably coupled to said base portion, said cap unit having a generally hollow body including radially outwardly convergent inner and outer side walls, a pair of aligned openings respectively formed through the side walls and disposed to be aligned with said coupling opening for receiving a coupling pin therethrough, a coupling pin disposed through said coupling opening and said aligned openings to retain said cap unit to said mounting pad assembly, and means for readily releasably locking said pin in said openings to prevent decoupling of said cap unit from said pad assembly, said cleat assembly being characterized by means restraining twisting of said cap unit with respect to said base portion, said means restraining twisting of said cap unit including seating surfaces slanting downwardly and away from opposite ends of said bracket and carried by said base portion, a pair of confronting substantially parallel abutments protruding from and extending radially outwardly along said inner walls of said cap unit, said means restraing twisting further including flanges extending along a pair of parallel side edges of said base portion, tapered side surfaces of said base portion formed to extend upwardly from said flanges to the level of the top surface of said base portion, transverse end walls extending between the end edges of said side walls and depending sufficiently to engage said base portion, said side walls of said cap unit protruding downwardly beyond said end walls and the top of said base portion at an angle to snugly fit alongside said tapered side surfaces while the ends of said side walls engage said side flanges to provide support therebetween.

11. A cleat assembly for attachment to a fill and compaction roller of a type having a rigid annular body, said assembly comprising a rigid mounting assembly having a base portion adapted to be secured to the body and a bracket integral to said base portion protruding generally radially outwardly therefrom, said bracket being formed to include a pair of lobes spaced in the direction of movement of said cleat assembly, said lobes being formed and spaced to include a transversely extending notch therebetween, each said lobe including a transversely extending coupling pin opening, and a hollow removable shoe formed and shaped to define a demolition cleat, said shoe having a generally hollow body including radially outwardly convergent inner and outer side walls, pairs of aligned openings respectively formed through the side walls and disposed to be aligned with said coupling openings for receving a coupling pin therethrough, a coupling pin disposed through said coupling openings and said aligned openings to retain said cap unit to said mounting assembly, and means for readily releasably locking said pins in said openings to prevent decoupling of said shoe from said mounting assembly, said cleat assembly being characterized by means restraining twisting of said shoe with respect to said base portion, said means restraining twisting of said shoe including a rigid cross bar extending between the inner walls of said shoe to strengthen said shoe, said cross bar being dimensioned to slide snugly into said slot and be restrained by said bracket.

12. A cleat assembly for attachment to a fill and compaction roller of a type having a rigid annular body, said assembly comprising a rigid mounting pad assembly having a base portion adapted to be welded to the body and an elongate bracket integral to said base portion protruding generally outwardly therefrom, a hollow readily removable shoe formed to include both a traction cleat portion and a demolition cleat portion disposed transversely of said traction cleat portion, said shoe including a pair of confronting immovable surfaces disposed to receive said bracket therebetween in closely spaced relation, openings formed through said bracket and through said shoe for receiving means therethrough for readily releasably coupling said shoe to said bracket and coupling means extending continuously through said bracket serving to secure said removable shoe to said base portion.

13. A cleat assembly according to claim 12, in which said base portion and said shoe include male and female portions respectively thereon and disposed to cooperate with each other to inhibit twisting of said shoe about an axis substantially normal to said base portion, said male portions being formed as a raised body carried by the upper surface of said base on opposite sides of said bracket, and said female portions being formed on the underside of said shoe in positions to cooperate with and receive said male portions therein.

14. A cleat assembly for attachment to a fill and compaction roller of a type having a rigid annular body, said assembly comprising a rigid mounting pad having a base portion adapted to be welded to the body and an elongate bracket integral to said base portion protruding generally outwardly therefrom, said elongate bracket being formed with downwardly divergent surfaces at the ends thereof tapered downwardly and away from each other at the opposite ends thereof, a hollow cap unit formed to be mounted onto said bracket, said cap unit having interior seating surfaces at opposite ends thereof for engaging said divergent surfaces of said bracket to provide a snug fit between said bracket and said cap unit, the tapered ends of said bracket serving to guide themselves into said seating surfaces of said cap unit, and means for readily releasably coupling said bracket and cap unit together, said cap unit having confronting spaced apart abutments therein, said bracket having registration surfaces disposed on opposite sides thereof to fit between said spaced abutments, said ends having laterally enlarged portions carrying engagement surfaces serving to cooperate with said seating surfaces of said cap unit.

15. A cleat assembly for attachment to a fill and compaction roller of a type having a rigid annular body, said assembly comprising:

a rigid mounting pad having a base portion adapted to be welded to the body and having a pair of generally triangular detents integral to the exposed surfaces of said base portion;

an elongate bracket integral to said base portion protruding generally outwardly therefrom, said elongate bracket being formed with downwardly divergent surfaces at the ends thereof tapered downwardly and away from each other at the opposite ends thereof;

a hollow cap unit formed to be mounted onto said bracket, said cap unit having interior seating surfaces at opposite ends thereof for engaging said divergent surfaces of said bracket to provide a snug fit between said bracket and said cap unit, the tapered ends of said bracket serving to guide themselves into said seating surfaces of said cap unit a pair of spaced notches for receiving said detents when said shoe is mounted on said base portion, said detents being engaged to inhibit twisting of said cap unit with respect to said base portion; and means for readily releasably coupling said bracket and cap unit together.

16. A cleat assembly for attachment to a fill and compaction roller of a type having a rigid annular body, said assembly comprising a rigid mounting pad assembly having a base portion adapted to be welded to the body and a bracket integral to said base portion protruding generally outwardly therefrom, a cap unit having a hollow interior formed to include a pair of spaced confronting immovable jaw means carried by the interior of said cap unit and defining a slot therebetween for receiving said bracket therein, an elongate coupling opening extending transversely through said bracket, said cap unit including sloping radially outwardly converging side walls and transverse end walls extending between the end edges of said side walls, a length of coiled spring wire disposed within and along the axial length of said coupling opening, said coiled spring wire having a central opening axially thereof, said wire being coiled to lie within an imaginary cylindrical configuration, both ends of said wire lying within said imaginary cylinder to permit said spring to be easily slidably inserted into said coupling opening in closely spaced relation therearound, a pair of aligned openings respectively formed through the side walls and aligned with said coupling opening and said central opening of said coiled spring wire for receiving a coupling pin therethrough, a coupling pin disposed through said coupling opening, said coiled spring wire, and said aligned opening to cause said length of coiled spring wire to engage said pin in a manner to retain said cap unit to said mounting pad assembly, said coiled spring wire readily releasably locking said pin in said openings to prevent decoupling of said cap unit from said pad assembly, while permitting the spring to elongate when said pin is struck by a hammer, such elongation serving to break up caked soil thereon otherwise inhibiting removal of said cap unit.

17. A cleat assembly according to claim 16 further comprising braces extending transversely of said bracket and integral to both said bracket and said base portion, and wherein each of said jaw means is subdivided to provide a space therebetween serving to receive an associated one of said braces therein.

18. A fill and compaction roller of a type having a rigid cylindrical body supported for rotation from a vehicle chassis and having cleat assemblies carried by the body, the cleat assemblies each comprising a rigid mounting pad assembly having a base portion welded to a said body and a bracket integral to said base portion protruding generally radially outwardly therefrom, a plurality of coupling openings extending transversely through said bracket in laterally spaced relation, a detachable cap unit readily releasably coupled to said base portion, said cap unit having a traction blade having a plurality of pairs of aligned openings disposed in alignment with said spaced coupling openings through said bracket when said parts are mated together, and a coupling pin extending continuously through said bracket and into one of said pair of said aligned openings to retain said cap unit to said bracket, said cap unit including demolition blade means integral with and extending crosswise of the plane of said traction blade, and means carried by said base portion protruding therefrom for engaging said cap unit to inhibit twisting of said cap unit with respect to said base portion.

19. A fill and compaction roller according to claim 18 wherein said demolition blade means comprises a pair of demolition blades respectively disposed at opposite ends of said traction blade.

20. A fill and compaction roller of a type having a rigid cylindrical body supported for rotation from a vehicle chassis and having cleat assemblies carried by the body, the cleat assemblies each comprising a rigid mounting pad having a base portion welded to said body and a bracket integral to said base portion protruding generally radially outwardly therefrom, a plurality of coupling openings extending transversely through said bracket in laterally spaced relation, a detachable cap unit readily releasably coupled to said base portion, said cap unit having a traction blade portion having a plurality of pairs of aligned openings disposed in alignment with said spaced coupling openings through said bracket, and a coupling pin disposed through one of a pair of said aligned openings and extending continuously through one of said coupling openings through said bracket to retain said cap unit to said bracket, said cap unit further including a pair of demolition blade portions extending transversely of said traction blade portion, said demolition blade portions being integral with said traction blade portion, and means carried by said base portion protruding therefrom for engaging said cap unit to inhibit twisting of said cap unit with respect to said base portion.

21. A cleat assembly for crushing, breaking and grinding trash materials comprising a rigid, elongate mounting base adapted to be welded to a rigid annular rotatable body, said base being formed to include an elongate aligning guide formed integrally with said base and disposed on said body, the ends of said guide being formed to slope downwardly toward said base and mutually away from each other, said guide extending substantially in a mid-plane between the sides of said base and protruding generally outwardly from said base, means forming an elongate removable wear cap having a hollow interior formed to include pockets at each end for snugly receiving the sloping ends of said guide therein and serving to restrain twisting of said wear cap relative to said base, and means for readily releasably coupling said wear cap to said base.

22. A cleat assembly for attachment to a fill and compaction roller of a type having a rigid annular body, said assembly comprising a rigid mounting pad assembly having a base portion adapted to be welded to the body and a bracket integral to said base portion protruding generally outwardly therefrom, a coupling opening extending transversely through said bracket, a cap unit adapted to be readily releasably coupled to said bracket, a pair of aligned openings formed through opposite sides of said cap unit and disposed to be aligned with said coupling opening for receiving a coupling pin therethrough, a coupling pin disposed through said coupling opening and said aligned openings to retain said cap unit to said mounting pad assembly, and means for readily releasably locking said pin in said openings to prevent decoupling of said cap unit from said pad assembly, said cap unit having a hollow interior formed to include pockets defined to receive the ends of said bracket therein and serving to restrain twisting of said wear cap relative to said base.

23. A cleat assembly for attachment to a fill and compaction roller of a type having a rigid annular body, said assembly comprising a rigid mounting pad having a base portion adapted to be welded to the body and an elongate bracket integral to said base portion protruding generally outwardly therefrom said elongate bracket being formed with downwardly divergent surfaces at the ends thereof tapered downwardly and away from each other at the opposite ends thereof, a hollow cap unit formed to be mounted onto said bracket, said cap unit having interior seating surfaces at opposite ends thereof for engaging said divergent surfaces of said bracket to provide a snug fit between said bracket and said cap unit, the tapered ends of said bracket serving to guide themselves into said seating surfaces of said cap unit, and means for readily releasably coupling said bracket and cap unit together, said cap unit having confronting spaced apart abutments therein, said bracket having a pair of spaced apart shoulders disposed on each of the opposite sides thereof to receive said spaced abutments.

* * * * *